US010508395B1

(12) United States Patent
Madden

(10) Patent No.: US 10,508,395 B1
(45) Date of Patent: Dec. 17, 2019

(54) PAVEMENT SWEEPING APPARATUSES AND METHODS

(71) Applicant: David S. Madden, Sibley, LA (US)

(72) Inventor: David S. Madden, Sibley, LA (US)

( * ) Notice: Subject to any disclaimer, the term of this patent is extended or adjusted under 35 U.S.C. 154(b) by 0 days.

(21) Appl. No.: 16/253,360

(22) Filed: Jan. 22, 2019

Related U.S. Application Data

(60) Provisional application No. 62/784,583, filed on Dec. 24, 2018.

(51) Int. Cl.

| | |
|---|---|
| ***E01H 1/04*** | (2006.01) |
| ***E01H 1/00*** | (2006.01) |
| ***E01H 1/02*** | (2006.01) |
| ***E01H 1/05*** | (2006.01) |
| ***E01H 1/10*** | (2006.01) |

(52) U.S. Cl.
CPC ..... *E01H 1/042* (2013.01); *E01H 1/003* (2013.01); *E01H 1/02* (2013.01); *E01H 1/05* (2013.01); *E01H 1/105* (2013.01)

(58) Field of Classification Search
CPC .. E01H 1/02; E01H 1/05; E01H 1/053; E01H 1/056; E01H 1/04; E01H 1/042; E01H 1/105; E01H 1/003; E01C 23/088
USPC ..... 15/78
See application file for complete search history.

(56) References Cited

U.S. PATENT DOCUMENTS

| | | | | |
|---|---|---|---|---|
| 1,510,880 | A * | 10/1924 | Aitken | E01H 1/042 15/84 |
| 3,893,286 | A | 7/1975 | Buttram et al. | |
| 4,001,908 | A | 1/1977 | Franklin | |
| 4,084,285 | A | 4/1978 | Herzog | |
| 4,290,820 | A | 9/1981 | Swisher, Jr. et al. | |
| 4,450,601 | A | 5/1984 | Shwayder | |
| 4,489,458 | A | 12/1984 | Schwayder | |
| 4,754,521 | A | 7/1988 | Zoni | |
| 4,872,233 | A | 10/1989 | Brown | |
| 4,912,798 | A | 4/1990 | Ganzmann | |
| 4,951,342 | A | 8/1990 | Wilson | |
| 5,361,441 | A * | 11/1994 | Williamson | E01H 1/042 15/83 |
| 6,360,396 | B1 | 3/2002 | Chao | |
| 7,024,719 | B2 | 4/2006 | Wilmo | |
| 7,996,955 | B2 | 8/2011 | Byczynski | |
| 2004/0045109 | A1 | 3/2004 | Wilmo | |
| 2010/0325824 | A1 | 12/2010 | Baum et al. | |
| 2016/0046225 | A1 | 2/2016 | Zanini | |

* cited by examiner

*Primary Examiner* — Laura C Guidotti
(74) *Attorney, Agent, or Firm* — R. Keith Harrison

(57) ABSTRACT

Pavement sweeping apparatuses may include a directionally mobile apparatus frame. At least one pickup unit may be carried by the apparatus frame. At least one actuatable first side edge broom may be carried by the apparatus frame generally on the first side and forward of the at least one pickup unit. At least one actuatable first side curb broom may be carried by the apparatus frame generally on the first side and forward of the at least one pickup unit. At least one actuatable second side edge broom may be carried by the apparatus frame generally on a second side and forward of the at least one pickup unit. At least one actuatable second side curb broom may be carried by the apparatus frame generally on the second side and forward of the at least one pickup unit. Pavement sweeping methods are also disclosed.

25 Claims, 33 Drawing Sheets

PAVEMENT SWEEPING APPARATUSES AND METHODS

CROSS-REFERENCE TO RELATED APPLICATIONS

This application claims the benefit of U.S. provisional application No. 62/784,583, filed Dec. 24, 2018 and entitled PAVEMENT SWEEPING APPARATUSES AND METHODS, which provisional application is hereby incorporated by reference herein in its entirety.

FIELD

Illustrative embodiments of the disclosure relate to pavement sweeping apparatuses and methods. More particularly, illustrative embodiments of the disclosure relate to pavement sweeping apparatuses which can be coupled to a pavement milling or cold planning machine to expeditiously and substantially remove or clean particulate milling particles from a milled or planed roadway or other pavement in a single pass preparatory to paving, and methods of sweeping milled pavement using such an apparatus.

SUMMARY

Illustrative embodiments of the disclosure are generally directed to pavement sweeping apparatuses which can be coupled to a pavement milling or cold planning machine to expeditiously and substantially remove or clean particulate milling particles from a milled or planed roadway or other pavement in a single pass preparatory to paving. An illustrative embodiment of the pavement sweeping apparatuses may include a directionally mobile apparatus frame. At least one pickup unit may be carried by the apparatus frame. At least one actuatable first side edge broom may be carried by the apparatus frame generally on the first side and forward of the at least one pickup unit. At least one actuatable first side curb broom may be carried by the apparatus frame generally on the first side and forward of the at least one pickup unit. At least one actuatable second side edge broom may be carried by the apparatus frame generally on a second side and forward of the at least one pickup unit. At least one actuatable second side curb broom may be carried by the apparatus frame generally on the second side and forward of the at least one pickup unit.

Illustrative embodiments of the disclosure are further generally directed to methods of sweeping a road surface having a mill cut including a mill cut bottom surface, a first side edge surface and a second side edge surface extending from the mill cut bottom surface and a first side curb surface and a second side curb surface extending from the first side edge surface and the second side edge surface, respectively. An illustrative embodiment of the methods may include positioning a pavement sweeping apparatus having at least one first side edge broom, at least one first side curb broom, at least one second side edge broom, at least one second side curb broom and at least one pickup unit over the road surface, and implementing the following simultaneously or in any order: positioning the at least one pickup unit over the mill cut bottom surface; positioning the at least one first side edge broom into contact with the bottom mill cut surface and the first side edge surface; positioning the at least one first side curb broom into contact with the first side curb surface; positioning the at least one second side edge broom into contact with the bottom mill cut surface and the second side edge surface; and positioning the at least one second side curb broom into contact with the second side curb surface; and simultaneously transporting the pavement sweeping apparatus along the road surface, sweeping milling particles from the bottom mill cut surface and the first side edge surface, the first curb surface, the bottom mill cut surface and the second side edge surface and the second curb surface into a pickup unit sweep path of the at least one pickup unit by actuation of the at least one first side edge broom, the at least one first side curb broom, the at least one second side edge broom and the at least one second side curb broom, respectively, and removing the milling particles from the pickup unit sweep path of the at least one pickup unit.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
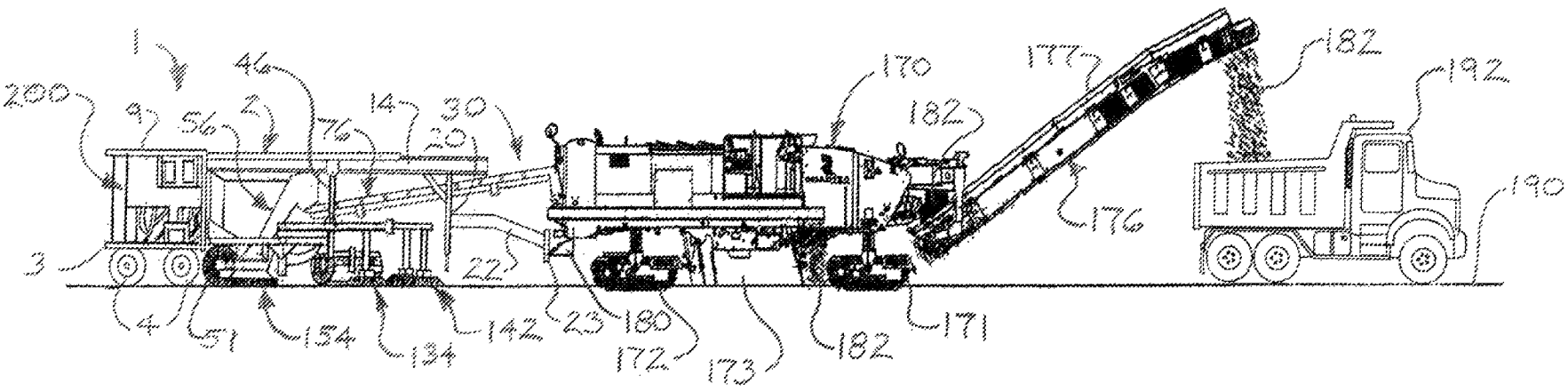
FIG. 1 is a typical right side view of an illustrative embodiment of the pavement sweeping apparatuses, with the illustrative apparatus coupled to a pavement milling or cold planning machine and removing particulate milling particles from a road surface after the pavement milling machine mills or planes the pavement in the road surface in typical application of the pavement sweeping apparatus.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower". "left side". "rear", "right side", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the terms "left side" and "right side" are interchangeable with "right side" and "left side", respectively. Hence, those components which are designated as being "left side" or "right side" in some of the described illustrative embodiments may be reversed in other embodiments.

As used herein, the terms "inwardly" and "outwardly" refer to toward and away from, respectively, the longitudinal midline axis 26 (FIG. 23) of the apparatus frame 2 of the pavement sweeping apparatus 1.

As used herein, the terms "front", "forward", "rear" and "behind" refer to the relative positions of components or elements as they relate to the direction of travel 6 (FIG. 26) of the apparatus 1 typically as the apparatus 1 typically follows the pavement milling machine 170.

As used herein, the term "side" refers to the relative positions of components or elements along a transverse axis 7 (FIG. 26) with respect to the direction of travel 6 of the apparatus 1.

Figure 2:
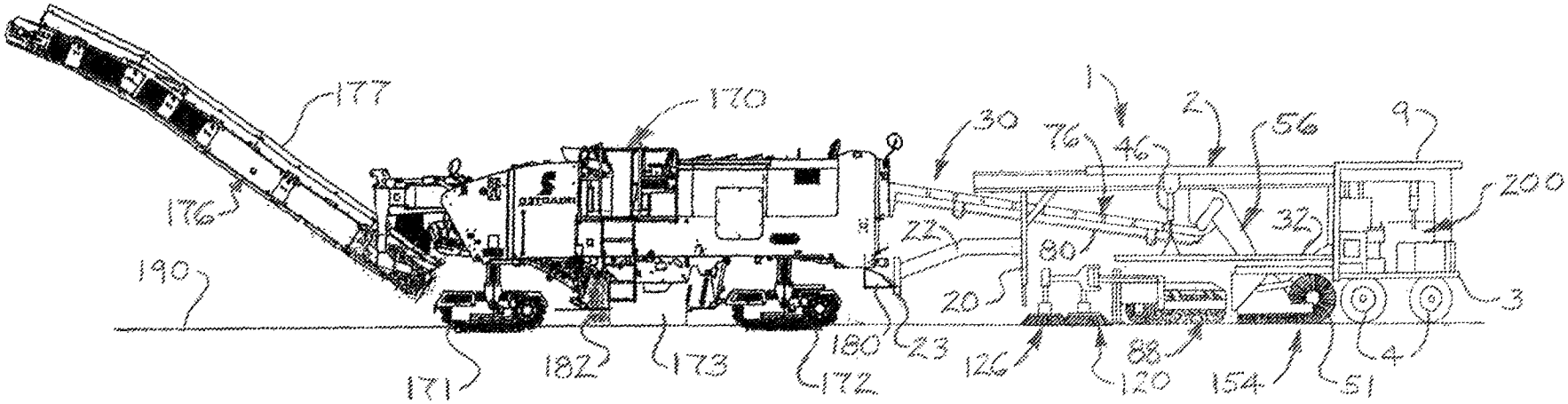
FIG. 2 is a typical left side view of the illustrative pavement sweeping apparatus and pavement milling or cold planing machine illustrated in FIG. 1.
Figure 3:
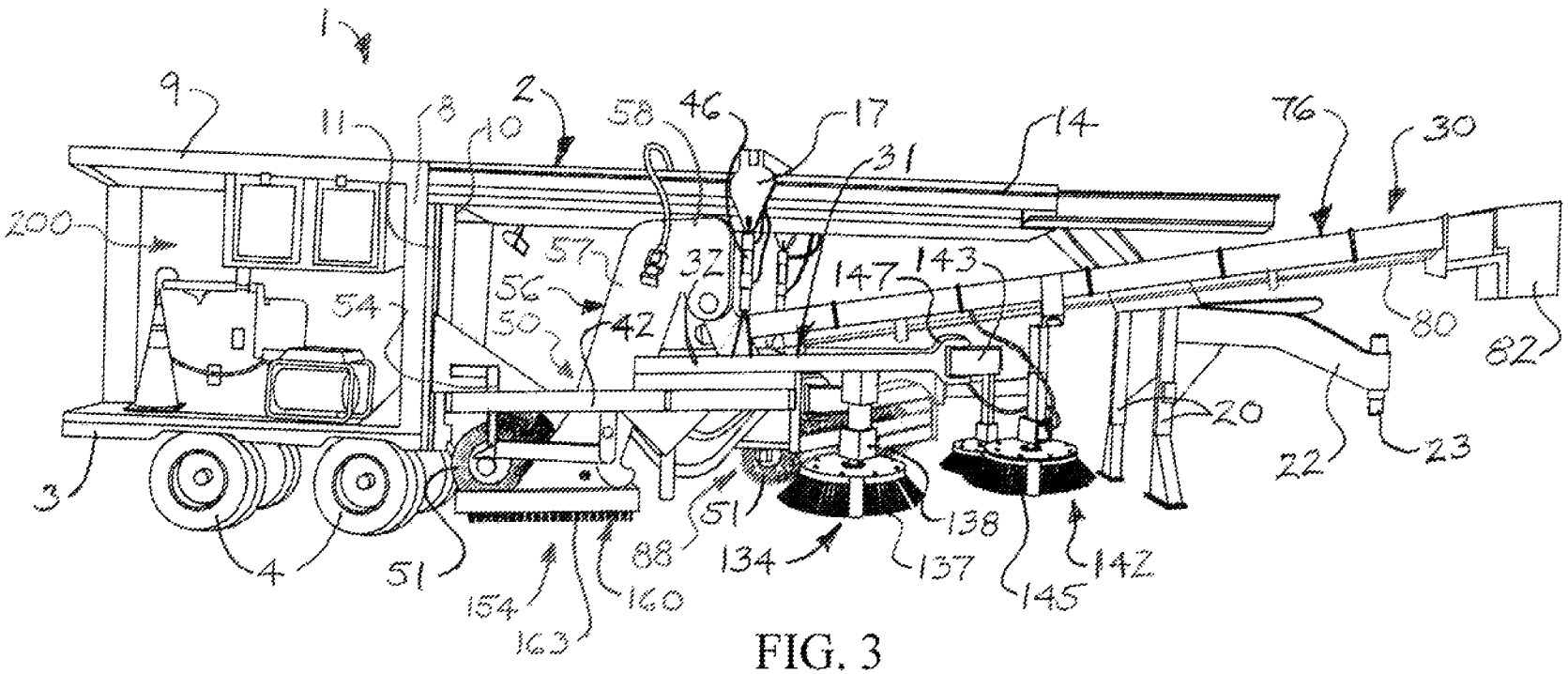
FIG. 3 is a typical right side perspective view of the illustrative pavement sweeping apparatus deployed in a typical folded non-functional, stowage or transport configuration.
Figure 4:
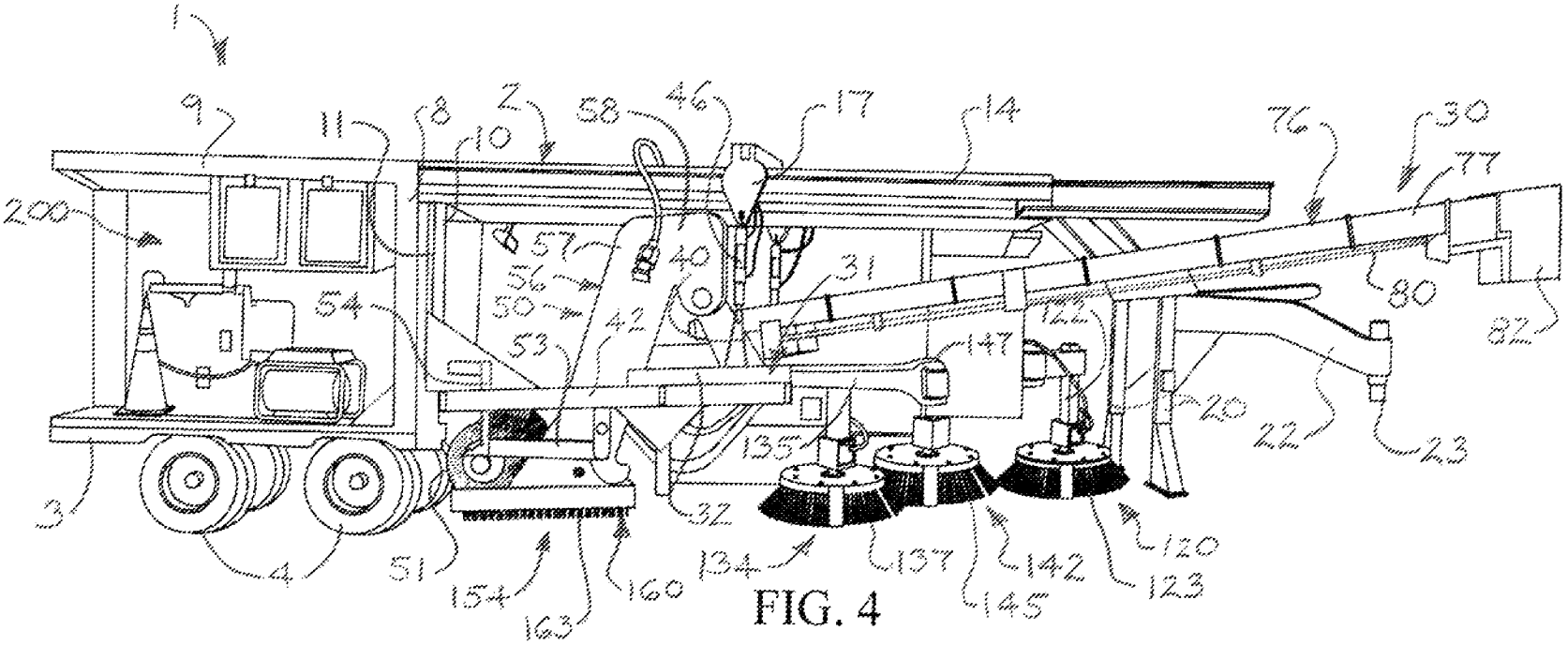
FIG. 4 is a typical right side perspective view of the illustrative pavement sweeping apparatus deployed in a typical extended functional, pavement-sweeping configuration.
Figure 24:
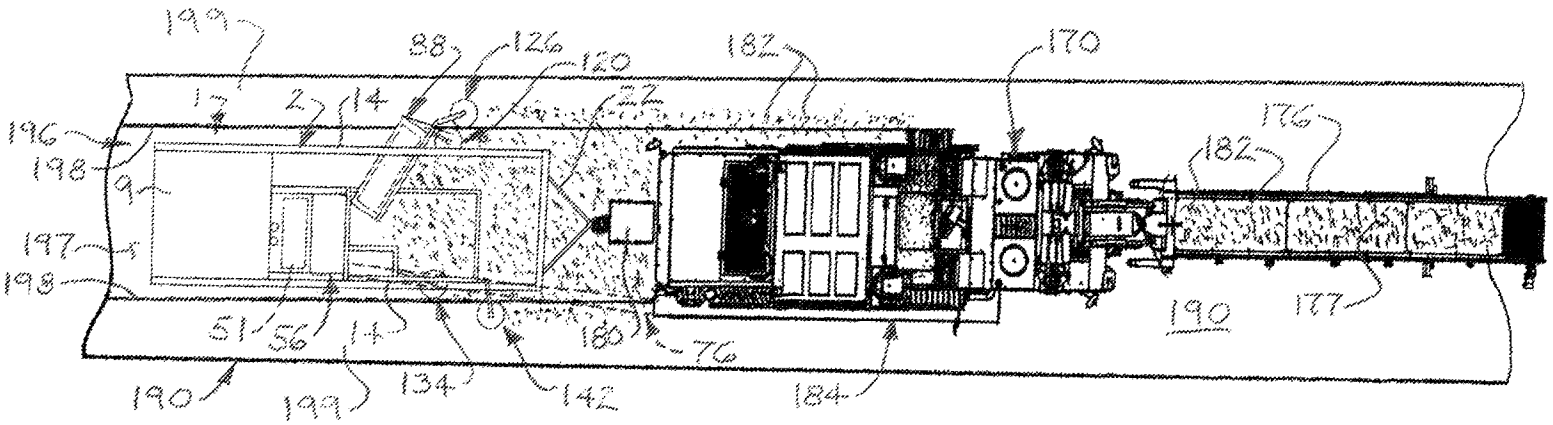
FIG. 24 is a top view of the illustrative pavement sweeping apparatus, coupled to a pavement milling or cold planing machine and removing milling particles from milled or planed pavement in a road surface as the apparatus is towed behind the pavement milling machine in typical application of the apparatus.

Referring initially to FIGS. 1, 2, 24-26 and 30 of the drawings, an illustrative embodiment of the pavement sweeping apparatuses, hereinafter apparatus, is generally indicated by reference numeral 1. As illustrated in FIGS. 1, 2 and 24 and will be hereinafter described, in typical application, the apparatus 1 may be coupled to a pavement milling or cold planing machine, hereinafter pavement milling machine 170, to substantially clean or remove milling particles 182 from a road surface 190 or other pavement surface after the pavement milling machine 170 forms a mill cut 196 (FIGS. 24-26) in the road surface 190. As used herein, "road surface" includes but is not limited to the surface of a road, highway, interstate or parking lot. Thorough and expeditious removal of the milling particles 182 from the mill cut 190 and adjacent portions of the road surface 190 in a single pass may facilitate optimal adhesion of asphalt which may be deposited thereon in a subsequent paving operation and may expedite completion of the milling, cleaning and paving operation, substantially increasing the efficiency and reducing costs associated with the operation. In some applications, the apparatus 1 may be capable of removing up to about 98% of the milling particles 182 from the milled road surface 190. In some embodiments or applications, the apparatus 1 may have a sweep width of 10'-15' in one forward pass or motion.

As illustrated in FIGS. 1, 2, 26 and 30, the pavement milling machine 170 may be a modified conventional pavement milling machine and may include a front track drive assembly 171 and a rear track drive assembly 172. At least one milling drum housing 173 (FIGS. 1 and 2) may house a milling drum 174 (FIG. 30) between the front track drive assembly 171 and the rear track drive assembly 172. A discharge conveyor assembly 176 having a discharge belt 177 may extend from the front end of the pavement milling machine 170. Accordingly, milling particles 182 dislodged from the road surface 190 by the rotating milling drum 174 as it forms the mill cut 196 may be thrown upwardly onto an intake conveyor 178 (FIG. 30) which may subsequently deposit the milling particles 182 onto the discharge belt 177 of the discharge conveyor assembly 176. As illustrated in FIG. 1, the discharge conveyor assembly 176 may discharge the milling particles 182 into successive dump trucks or other transport vehicles, hereinafter dump trucks 192, positioned on the pre-milled road surface 190 in front of the discharge conveyor assembly 176. When full, each dump truck 192 may transport the milling particles 182 to a suitable destination and unload the milling particles 182 as an empty dump truck 192 is positioned to continue receiving the discharged milling particles 182.

Figure 25:
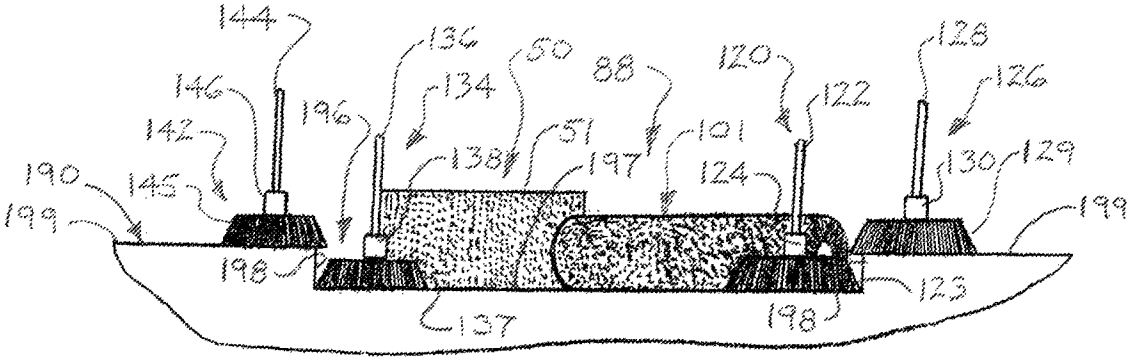
FIG. 25 is a front cross-sectional view of the milled pavement, more particularly illustrating a typical spatial configuration and engagement of the left side curb broom and left side edge broom (shown on the right side of the figure), directing broom, right side curb broom and right side edge broom (shown on the right side of the figure) and pickup broom with the pavement as the brooms remove the milling particles from the pavement.
Figure 26:
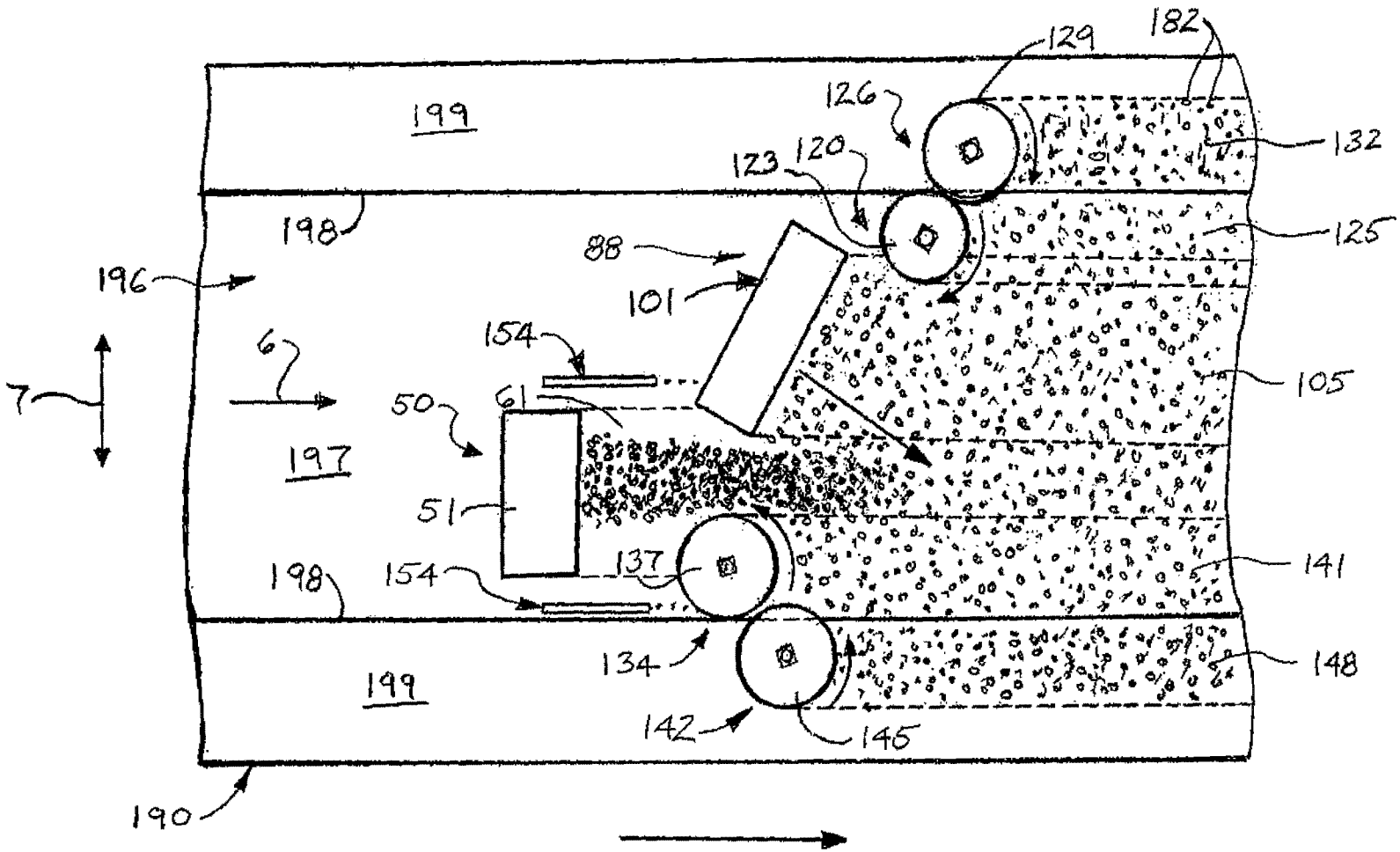
FIG. 26 is a top view of the milled pavement, illustrating the typical spatial configuration of the brooms on the milled pavement as the brooms remove the milling particles from the pavement.

As illustrated in FIGS. 25 and 26, the mill cut 196 formed by the pavement milling machine 170 may have a bottom mill cut surface 197. A pair of parallel, spaced-apart, typically vertical edge surfaces 198 may extend from the bottom mill cut surface 197. Curb surfaces 199 may extend outwardly from the respective edge surfaces 198 away from the mill cut 196. Accordingly, the apparatus 1 may substantially and expeditiously remove the milling particles 182 from the bottom mill cut surface 197, the edge surfaces 198 and the curb surfaces 199 typically preparatory to subsequent paving of the road surface 190. The apparatus 1 may travel at a sweep speed which corresponds to the milling speed or travel speed of the pavement milling machine 170, and thus, remove the milling particles 182 from the milled road surface 190 at a sweep rate or removal rate that equals the milling speed or milling rate of the pavement milling machine 170 in a single pass. Typical travel speeds for the pavement milling machine 170 may range from about 1 foot/min to about 90 feet/min. In some applications, the apparatus 1 may remove the milling particles 182 from the milled road surface 190 within from about 5 seconds to about 60 seconds of the moment at which the pavement milling machine 170 forms the mill cut 196 in the road surface 190, depending typically on the travel speed of the pavement milling machine 170, typically from about 1 foot/min to about 90 feet/min.

Figure 30:
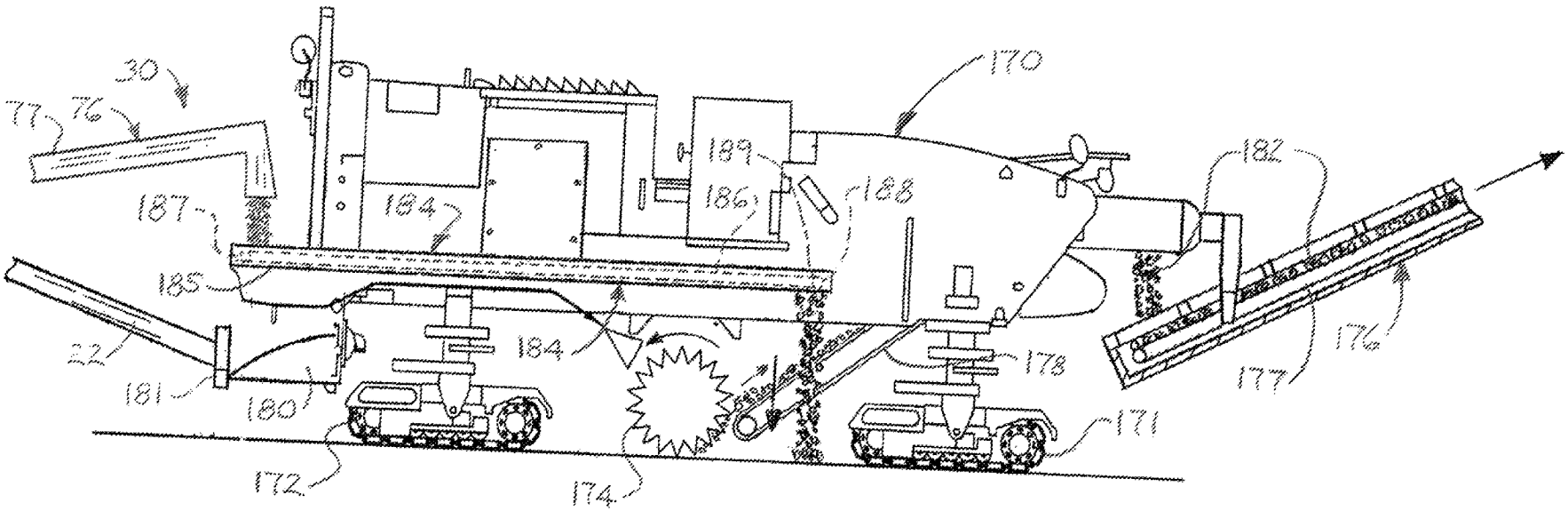
FIG. 30 is a side view of the pavement milling or cold planing machine as the milling particles are discharged from the sweeper conveyor assembly of the apparatus onto the primary conveyor assembly on the pavement milling or cold planing machine and then from the primary conveyor assembly on the pre-milled pavement in front of the milling drum as the pavement milling or cold planing machine mills or planes the road surface and discharges the milling particles onto a discharge conveyor assembly on the pavement milling or cold planing machine.

As illustrated in FIGS. 25 and 26, the apparatus 1 may include at least one left side edge broom assembly 120 having at least one left side edge broom 123, at least one left side curb broom assembly 126 having at least one left side curb broom 129, at least one right side edge broom assembly 134 having at least one right side edge broom 137 and at least one right side curb broom assembly 142 having at least one right side curb broom 145. The left side edge broom 123 and the right side edge broom 137 may engage the respective edge surfaces 198 of the mill cut 196, whereas the left side curb broom 129 and the right side curb broom 145 may engage the respective curb surfaces 199 on opposite sides of the mill cut 196. In some embodiments, the apparatus 1 may further include at least one directing broom assembly 88 having at least one directing broom 101. The apparatus 1 may include at least one pickup unit 50 which may have at least one pickup broom 51. The directing broom 101 may be oriented at an angle with respect to the direction of travel 6 (FIG. 26) of the apparatus 1. Accordingly, in typical operation of the apparatus 1, the left side edge broom 123 and the right side edge broom 137 may rotate and sweep the milling particles 182 from the respective edge surfaces 198 onto the bottom mill cut surface 197 and into the path of the typically rotating directing broom 101 and pickup broom 51, respectively. In like manner, the left side curb broom 129 and the right side curb broom 145 may rotate and sweep the milling particles 182 from the respective curb surfaces 199 onto the bottom mill cut surface 197 and into the path of the rotating directing broom 101 and pickup broom 51, respectively. The directing broom 101 may sweep the milling particles 182 into the path of the rotating pickup broom 51, which may sweep the milling particles 182 from the bottom mill cut surface 197 into the pickup unit 50. As illustrated in FIG. 30, the swept and picked-up milling particles 182 may ultimately be deposited in front of the milling drum 174 of the pavement milling machine 170, and then onto the discharge conveyor assembly 176 with the freshly-removed milling particles 182 and into the dump truck 192, respectively. Consequently, the bottom mill cut surface 197, the edge surfaces 198 and the curb surfaces 199 of the milled road surface 190 may be substantially free of the milling particles 182 preparatory to subsequent paving of the road surface 190. In some embodiments, the apparatus 1 may include at least one curb shoe broom assembly 154 to deflect stray milling particles 182 into the path of the pickup broom 51. Each of the pickup broom 51, the directing broom 101, the left side edge broom 123, the left side curb broom 129, the right side edge broom 137, the right side curb broom 145 may be selectively actuatable in such a manner as to effect their respective sweeping functions. "Actuatable" may include but is not limited to clockwise or counterclockwise rotation. In some embodiments or applications, the left edge broom 123 of the left edge broom assembly 120 and the right edge broom 137 of the right edge broom assembly 134 may each have a sweep width of 12"-18" of the bottom mill cut surface 197 along the respective edge surfaces 198.

Figure 32:
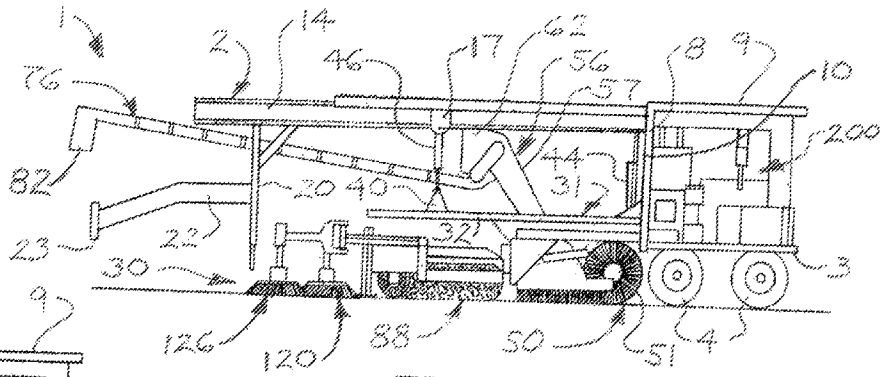
FIG. 32 is a side view of the pavement sweeping apparatus with the sweeper assembly in a raised position on the apparatus frame.
Figure 33:
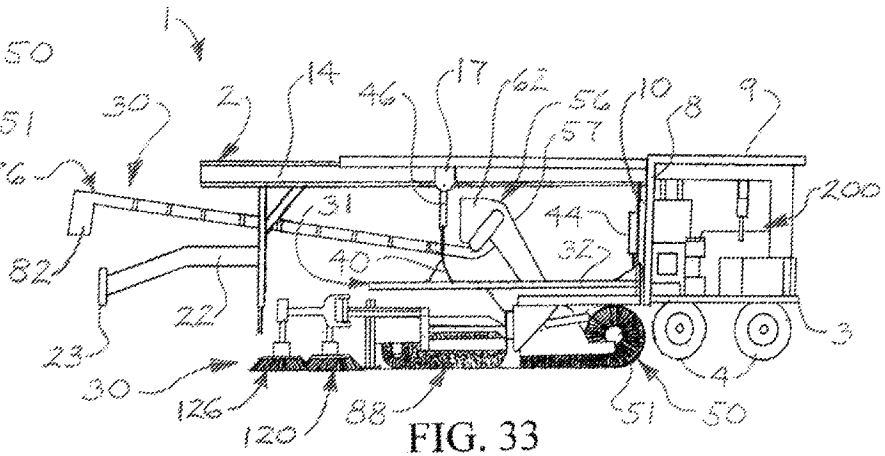
FIG. 33 is a side view of the pavement sweeping apparatus with the sweeper assembly in a lowered position on the apparatus frame.
Figure 31:
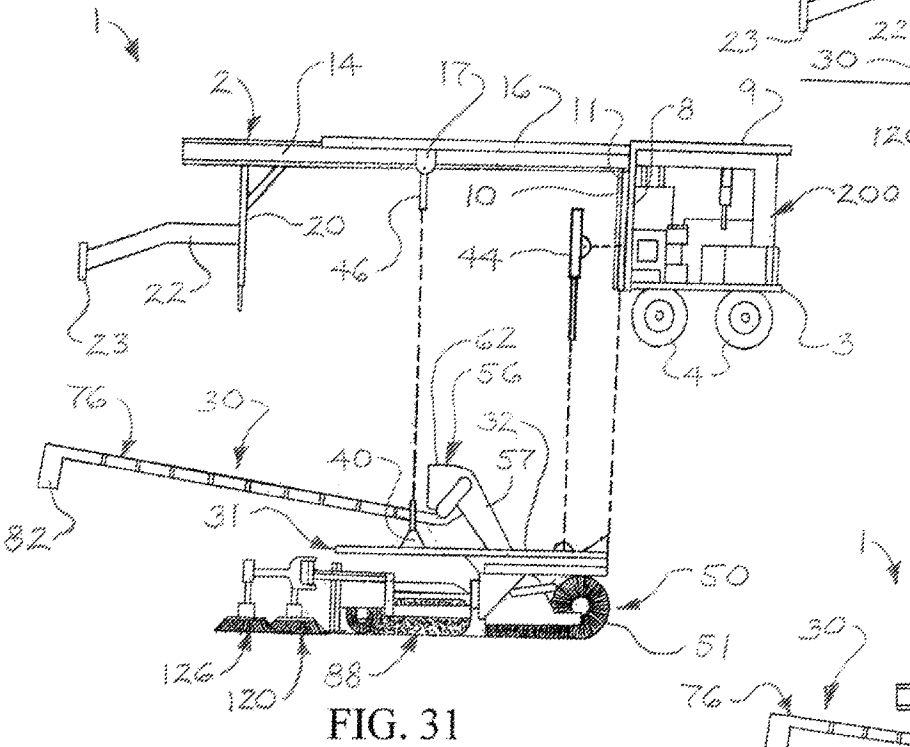
FIG. 31 is an exploded side view of the illustrative pavement sweeping apparatus, more particularly illustrating typical positionally adjustable mounting of a sweeper assembly on an apparatus frame.
Figure 34:
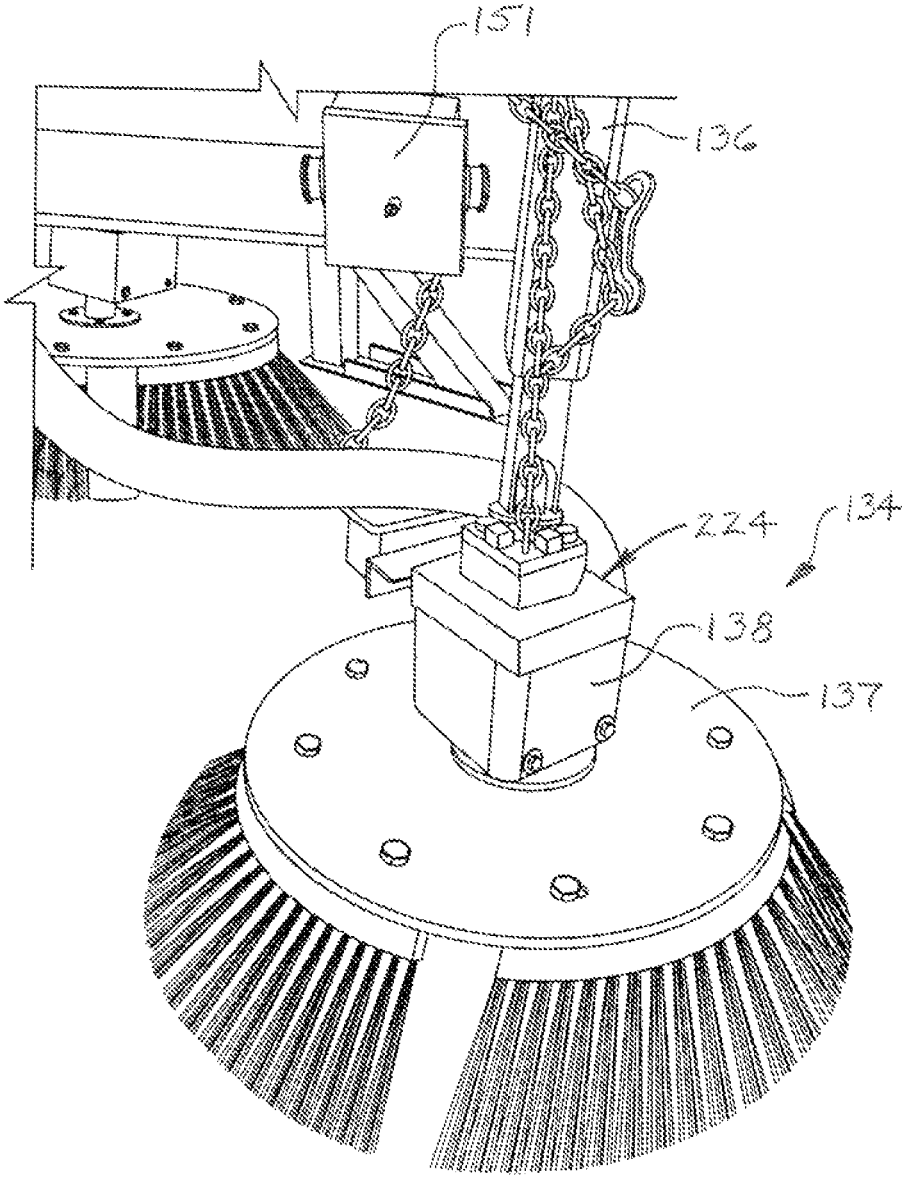
FIG. 34 is a perspective view of a typical right side curb broom assembly having a gimbal joint assembly according to some illustrative embodiments of the pavement sweeping apparatuses.

Referring next to FIGS. 3-17, 22, 23 and 27-33 of the drawings, the apparatus 1 may include a directionally mobile apparatus frame 2. As used herein, the term "directionally mobile" refers to the capability of the apparatus frame 2 to travel on or over the roadway surface 190 in the direction of travel 6 (FIG. 26), whether by being towed or carried by another vehicle or by operation of an on-board power and traction mechanism. As illustrated in FIGS. 31-33, the apparatus 1 may further include a sweeper assembly 30 on the apparatus frame 2. The sweeper assembly 30 may include the left side edge broom assembly 120, the left side curb broom assembly 126, the right side edge broom assembly 134, the right side curb broom assembly 142, the directing broom assembly 88 and the pickup unit 50. As illustrated in FIGS. 32 and 33, in some embodiments, the sweeper assembly 30 may be selectively vertically adjustable on and with respect to the apparatus frame 2 typically as will be hereinafter described.

As illustrated in FIGS. 3-6, the apparatus frame 2 of the apparatus 1 may have a gooseneck design with a chassis 3 having wheels 4 on tandem axles. The chassis 3 may include a chassis wall 8. A ceiling portion 9 may extend rearwardly from the chassis wall 8. At least some of the components of an apparatus control system 200, which will be hereinafter described, may be provided on the chassis 3 beneath the ceiling portion 9.

Figure 22:
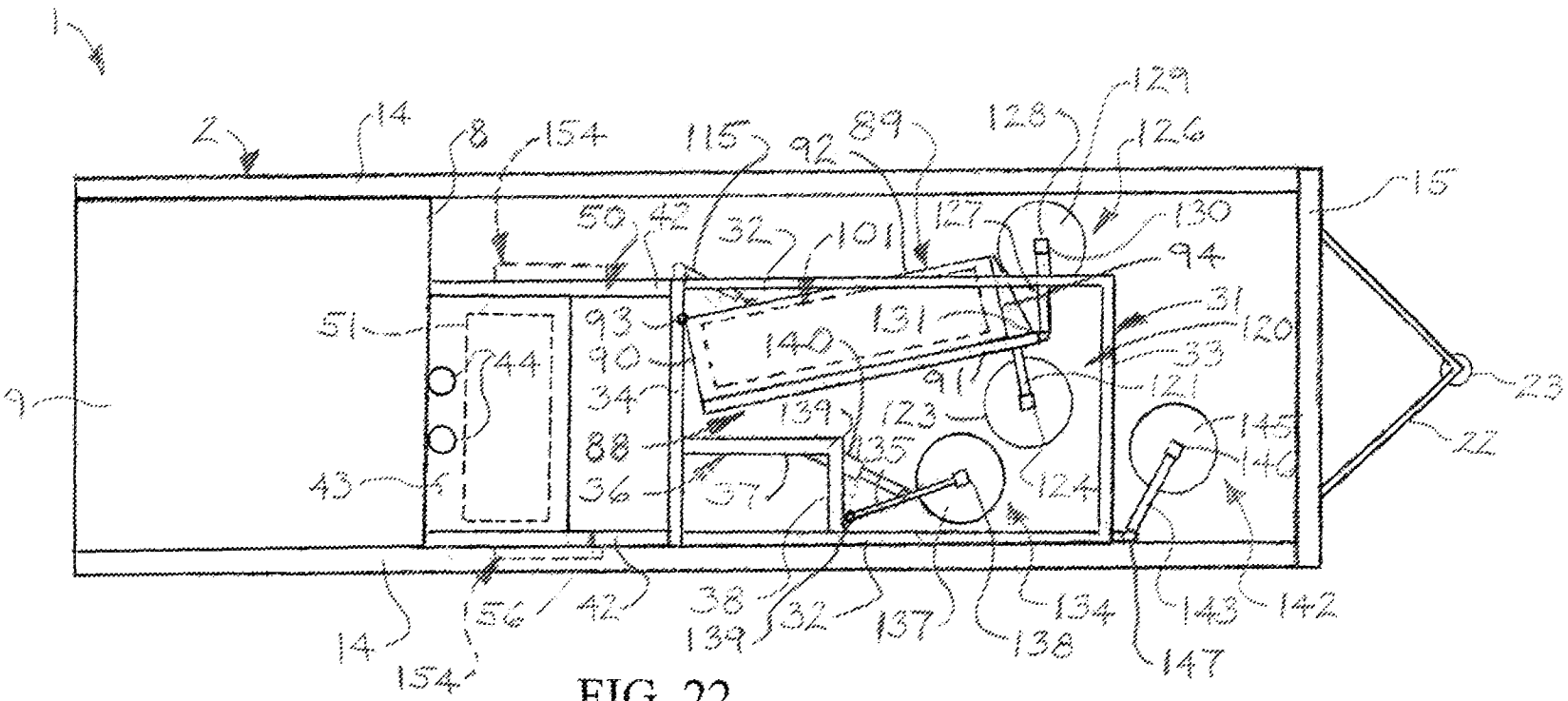
FIG. 22 is a top view of the illustrative pavement sweeping apparatus, with the left side edge broom assembly, left side curb broom assembly, directing broom assembly, right side edge broom assembly and right side curb broom assembly in the transport configuration.
Figure 23:
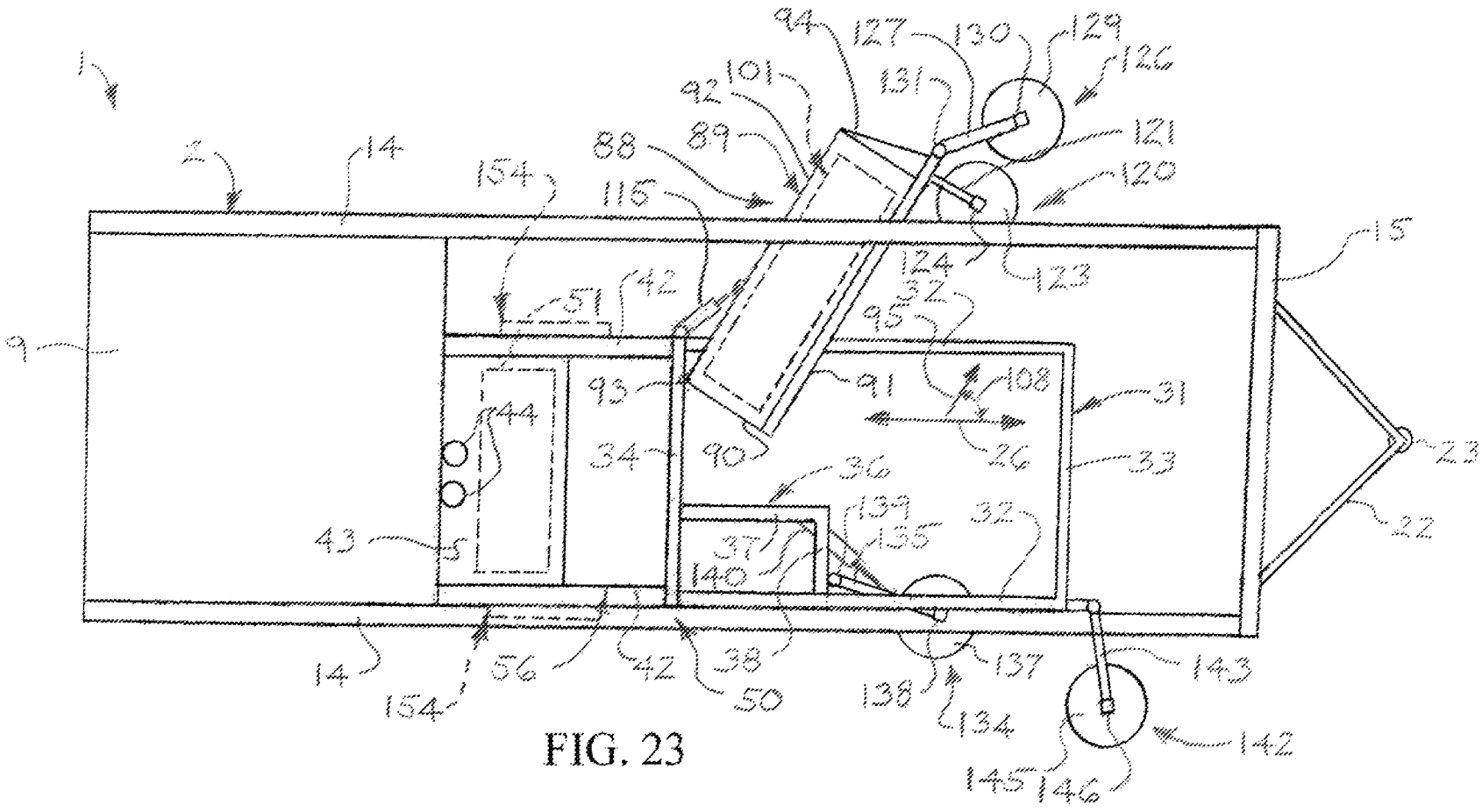
FIG. 23 is a top view of the illustrative pavement sweeping apparatus, with the left side edge broom assembly, left side curb broom assembly, directing broom assembly, right side edge broom assembly and right side curb broom assembly in the functional configuration.

A pair of elongated, parallel, spaced-apart overhead frame members 14 may extend forwardly from the chassis wall 8 of the chassis 3. As illustrated in FIGS. 22 and 23, a front frame member 15 may extend between the forward ends of the overhead frame members 14. Frame stabilizing members 18 (FIG. 9) may extend between the overhead frame members 14. At least one actuator mount member 16 may be provided on each overhead frame member 14 for purposes which will be hereinafter described.

At least one frame support arm 20 may extend downwardly from at least one of the overhead frame members 14. The frame support arm 20 may support the apparatus frame 2 on the ground when the apparatus 1 is uncoupled from the pavement milling machine 170 or a towing vehicle. At least one hitch frame 22 may extend forwardly from the apparatus frame 2. At least one hitch coupling 23 may extend from the hitch frame 22. The hitch coupling 23 may be configured to engage a companion hitch receptacle 181 (FIG. 29) on a hitch receptacle 180 on the pavement milling machine 170 to facilitate coupling of the apparatus 1 to the pavement milling machine 170, typically as will be hereinafter described.

As further illustrated in FIGS. 31-33, in some embodiments, the sweeper assembly 30 may include a sweeper assembly frame 31. The left side edge broom assembly 120, left side curb broom assembly 126, right side edge broom assembly 134, right side curb broom assembly 142, directing broom assembly 88 and pickup unit 50 may be provided on the sweeper assembly frame 31. At least one sweeper assembly elevation frame member 10 may extend forwardly from the chassis wall 8. Each sweeper assembly elevation frame member 10 may have an elongated, vertical track slot 11. Accordingly, the sweeper assembly frame 31 of the sweeper assembly 30 may engage and traverse the track slots 11 of the respective sweeper elevation frame members 10 as the sweeper assembly 30 is raised and lowered on the apparatus frame 2.

At least one rear sweeper assembly elevation actuator 44, which may be hydraulic, pneumatic or electric, may be provided on the chassis wall 8 of the chassis 3. The rear sweeper assembly elevation actuator 44 may operably engage the sweeper assembly frame 31. In some embodiments, at least one side sweeper assembly elevation actuator 46, which may be hydraulic, pneumatic or electric, may be mounted on at least one of the actuator mount members 16 on the apparatus frame 2, such as via a corresponding actuator mount flange 17. Each side sweeper assembly elevation actuator 46 may operably engage the sweeper assembly frame 31 typically via an actuator mount flange 40. Accordingly, selective operation of the rear sweeper assembly elevation actuators 44 and the side sweeper assembly elevation actuators 46 may facilitate selective raising and lowering of the sweeper assembly 30 on the apparatus frame 2, as illustrated in FIGS. 32 and 33, and for purposes which will be hereinafter described.

As illustrated in FIGS. 22 and 23, the sweeper assembly frame 31 may include a pair of elongated, parallel, spaced-apart pickup unit support members 42 which may extend forwardly from the chassis wall 8 of the chassis 3. A pickup unit support panel 43 may extend between the pickup unit support members 42. A pair of elongated, parallel, spaced-apart side assembly frame members 32 may extend forwardly from the respective pickup unit support members 42. A front assembly frame member 33 and a rear assembly frame member 34 may extend between the side assembly frame members 32.

As further illustrated in FIGS. 22 and 23, in some embodiments, the sweeper assembly frame 31 may include a broom mount frame 36. The broom mount frame 36 may include a longitudinal mount frame member 37 which may extend from the rear assembly frame member 34. A transverse mount frame member 38 may extend between the longitudinal mount frame member 37 and a corresponding side assembly frame member 32 of the sweeper assembly frame 31.

As further illustrated in FIGS. 22 and 23, in some embodiments, the directing broom assembly 88 may be mounted on the rear assembly frame member 34 of the sweeper assembly frame 31. The left side edge broom assembly 120 and the left side curb broom assembly 126 may be mounted on the directing broom assembly 88. The right side edge broom assembly 134 may be mounted on the transverse mount frame member 38 of the broom mount frame 36. The right side curb broom assembly 142 may be mounted on the front assembly frame member 33 of the sweeper assembly frame 31. The pickup unit 50 may be mounted on the pickup unit support panel 43. However, it will be recognized and understood that the sweeper assembly frame 31 may have alternative designs and the broom assemblies and the pickup assembly 50 may be mounted in alternative positions which are consistent with the required spatial relationships between the brooms and the functional requirements of the apparatus 1. The left side edge broom assembly 120, the let curb broom assembly 126, the right side edge broom assembly 134, the right side curb broom assembly 142 and the directing broom assembly 88 may be selectively deployable between the folded, storage or transport configuration illustrated in FIG. 22 and the extended, functional configuration illustrated in FIG. 23. In the storage or transport configuration, the left side edge broom assembly 120, the let curb broom assembly 126, the right side edge broom assembly 134, the right side curb broom assembly 142 and the directing broom assembly 88 may be disposed within the confines of the area or perimeter of the apparatus frame 2, as further illustrated in FIG. 22, to facilitate space-efficient storage and/or meet road transport requirements in transport of the apparatus 1.

Figure 7:
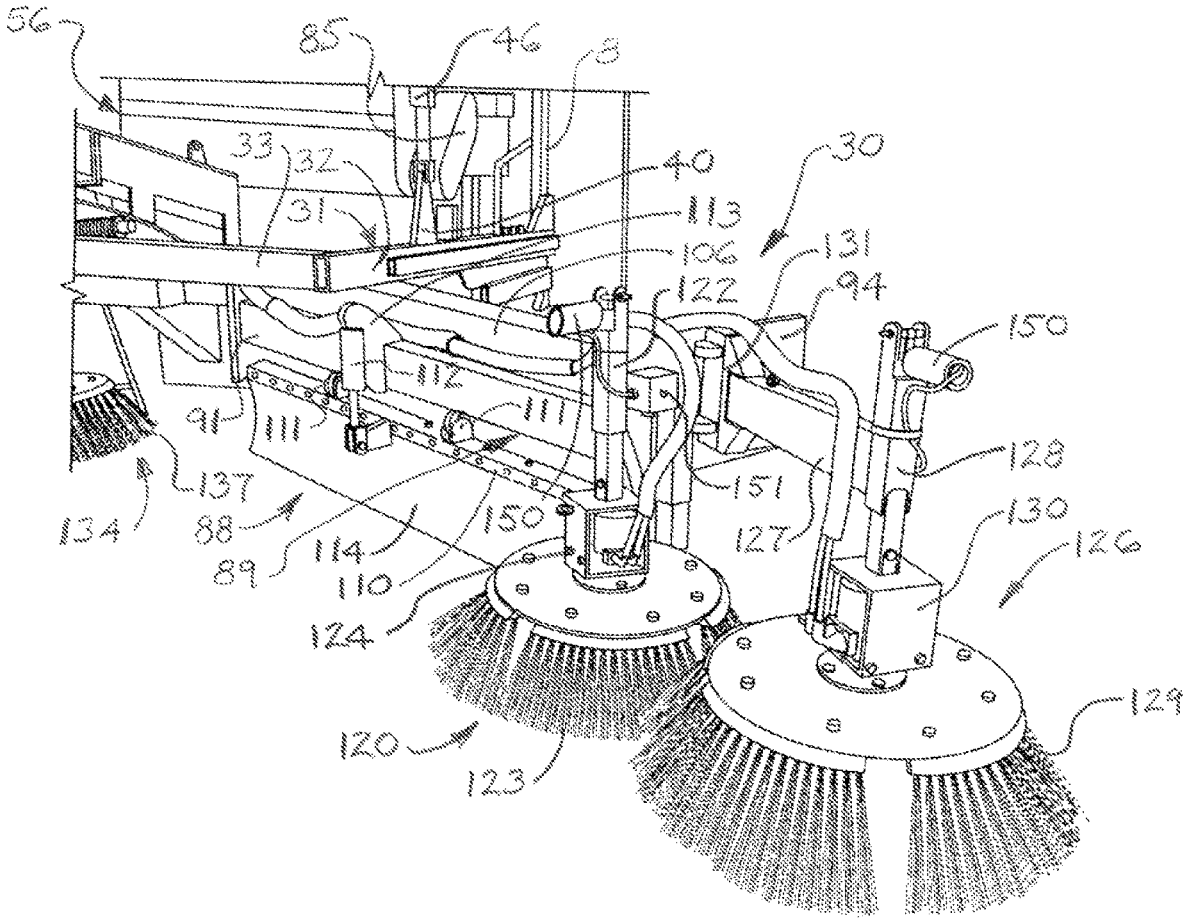
FIG. 7 is a typical front left side perspective view of the pavement sweeping apparatus, more particularly illustrating an exemplary left side curb broom assembly, left side edge broom assembly and directing broom assembly of the apparatus, deployed in the functional configuration.
Figure 8:
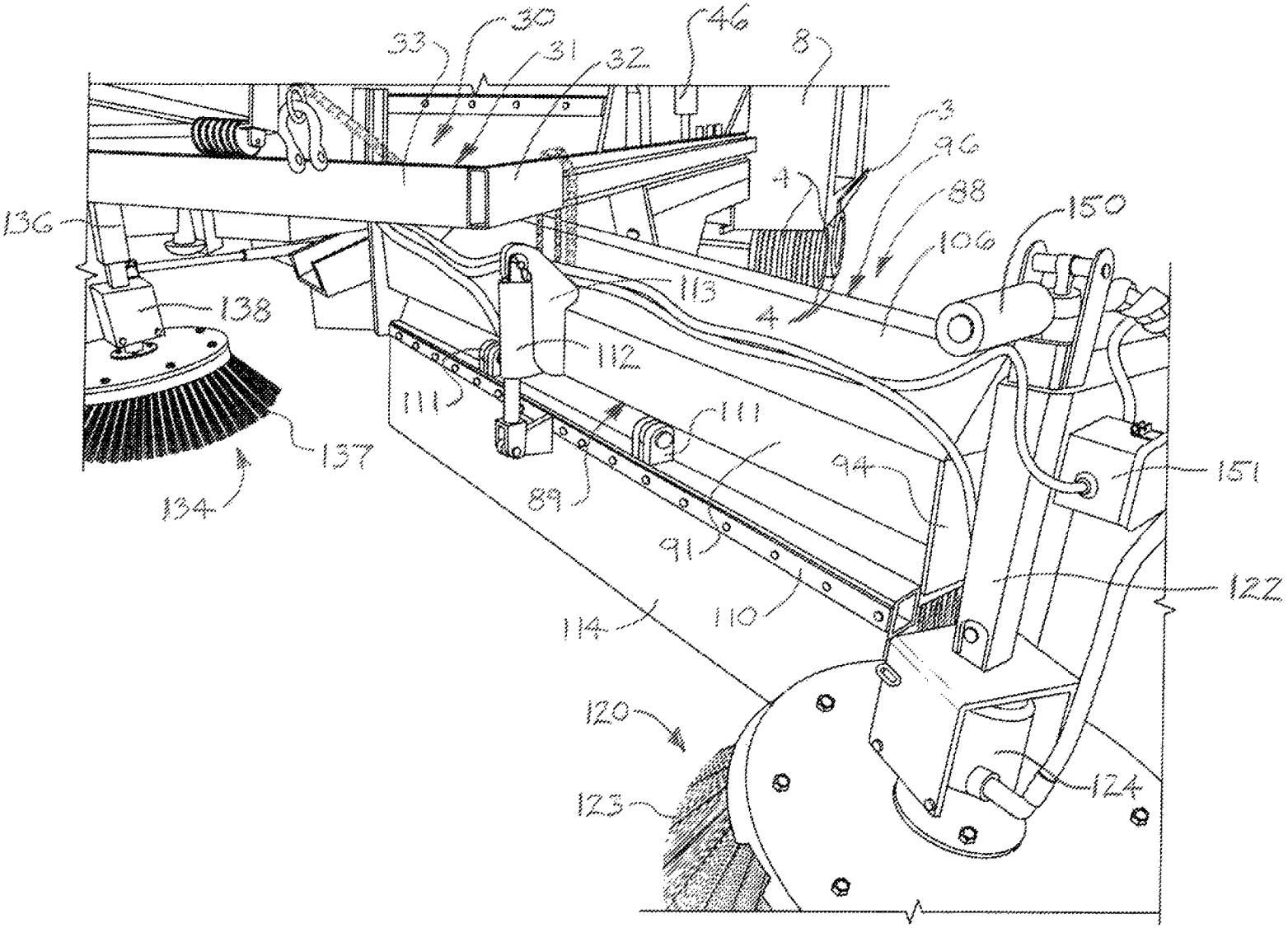
FIG. 8 is a front perspective view of the left side edge broom assembly, directing broom assembly and right side edge broom assembly in the functional configuration.
Figure 9:
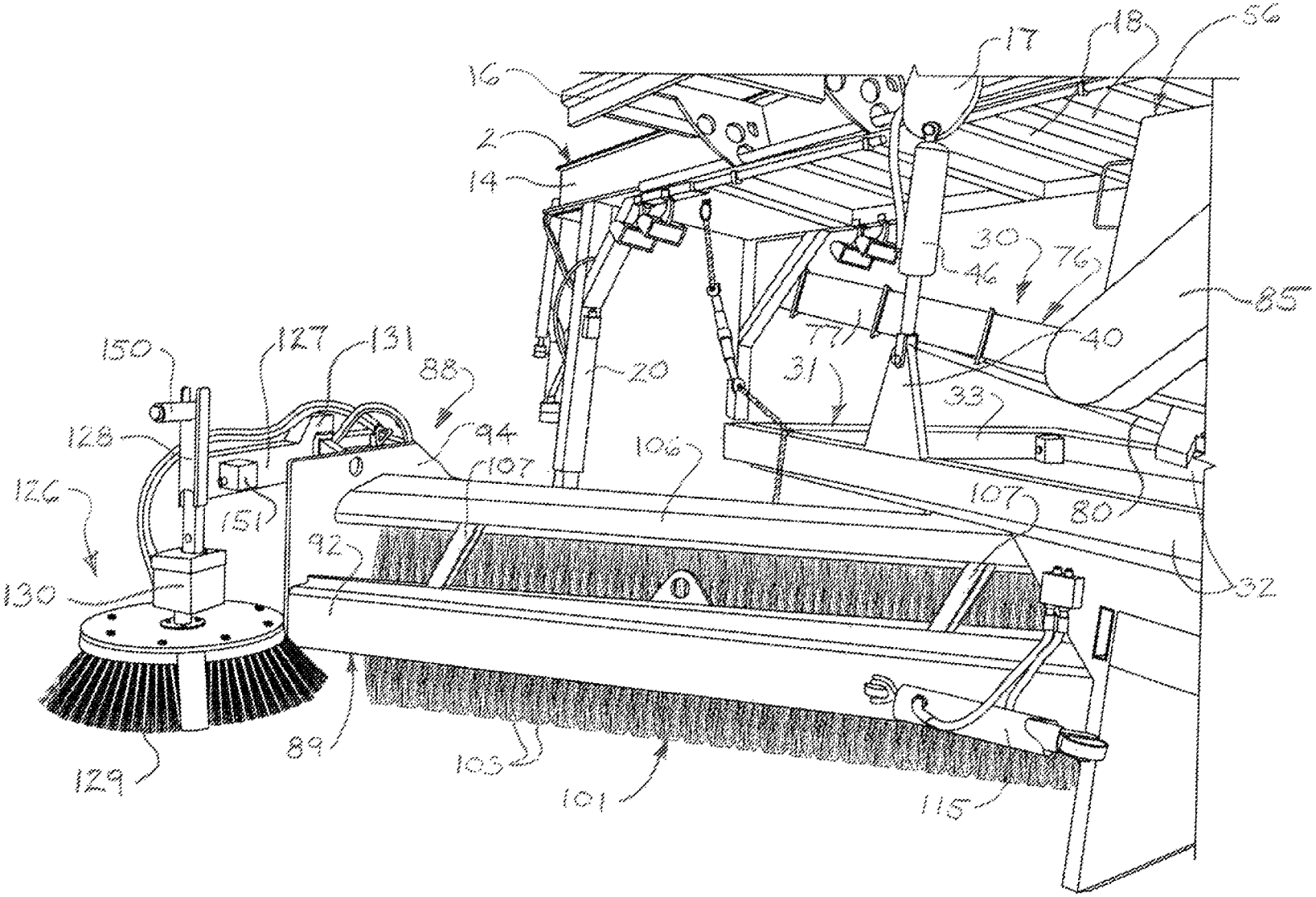
FIG. 9 is a rear perspective view of the left side curb broom assembly and the directing broom assembly, with the directing broom assembly in the functional configuration and the left side curb broom assembly in the folded, transport configuration.
Figure 11:
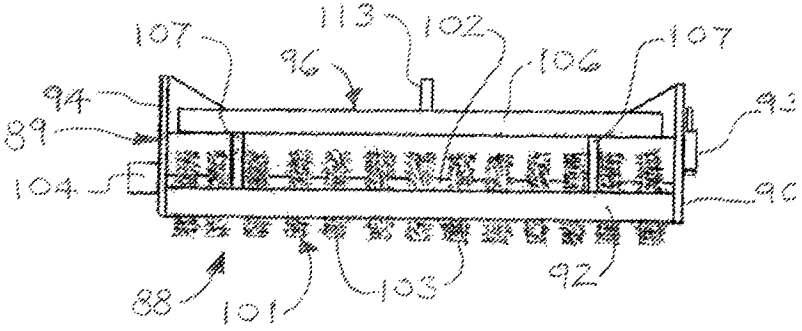
FIG. 11 is a rear view of the directing broom assembly.
Figure 13:
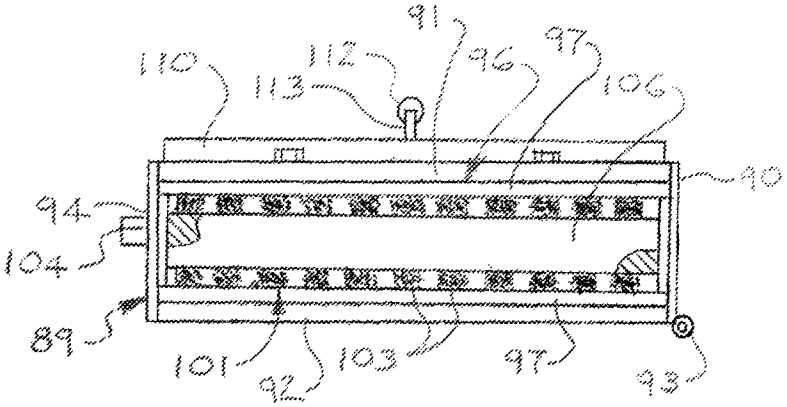
FIG. 13 is a top view of the directing broom assembly.
Figure 12:
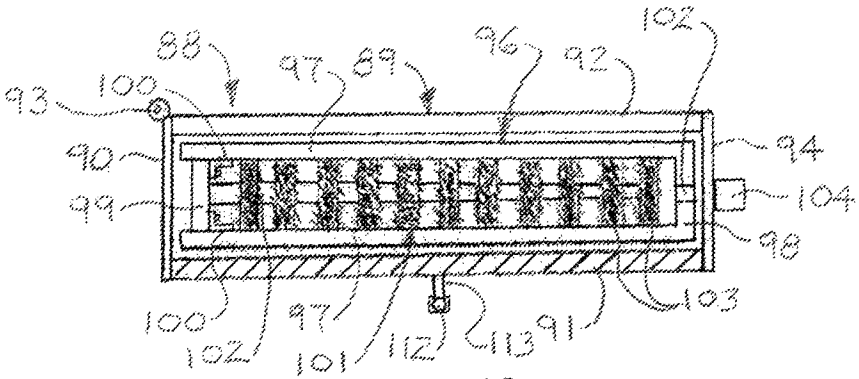
FIG. 12 is a sectional view, taken along section lines 12-12 in FIG. 10, of the directing broom assembly.

As illustrated in FIGS. 7-16, the directing broom assembly 88 may include a directing broom assembly frame 89 which may be generally elongated and rectangular. As illustrated in FIGS. 10-13, the directing broom assembly frame 89 may include an inner frame plate 90 and an outer frame plate 94 disposed in parallel, spaced-apart relationship to each other. As illustrated in FIGS. 12 and 13, a front frame member 91 and a rear frame member 92 may extend between the inner frame plate 90 and the outer frame plate 94 in parallel, spaced-apart relationship to each other. As illustrated in FIG. 23, in the extended, functional configuration of the directing broom assembly 88, the outer frame plate 94 may be disposed outwardly of the apparatus frame 2 and the front frame member 91 may be disposed forwardly of the rear frame member 92. A frame hinge 93 may pivotally connect the directing broom assembly frame 89 to the rear assembly frame member 34 of the sweeper assembly frame 31. The frame hinge 93 may be provided at or adjacent to the corner or junction between the inner frame plate 90 and the rear frame member 92. As illustrated in FIG. 9, in some embodiments, at least one broom positioning actuator 115, which may be hydraulic, pneumatic or electric, may extend from the sweeper assembly frame 31 and attach typically to the rear frame member 92 of the broom assembly frame 89. Accordingly, operation of the broom positioning actuator 115 may pivot the directing broom assembly 88 between the folded, storage or transport configuration (FIG. 22) and the extended, functional configuration (FIG. 23).

A broom mount frame 96 may be mounted in the directing broom assembly frame 89. As illustrated in FIG. 12, the broom mount frame 96 may include a pair of elongated, parallel, spaced-apart side mount frame members 97. An end mount frame member 98 may connect the side mount frame members 97. A shaft bearing 99 may extend between the side mount frame members 97 opposite the end mount frame member 98. At least one bearing bracket 100 may attach the shaft bearing 99 to the side mount frame members 97.

A directing broom 101 may include an elongated broom shaft 102 which may be journaled for rotation between the end mount frame member 98 and the shaft bearing 99 of the broom mount frame 96. Shaft bristles 103 may extend outwardly from the broom shaft 102. A directing broom motor 104 may drivingly engage the broom shaft 102 for rotation. In some embodiments, the directing broom motor 104 may be hydraulic. Accordingly, operation of the directing broom motor 104 may rotate the directing broom 101 in the broom mount frame 96.

Figure 14:
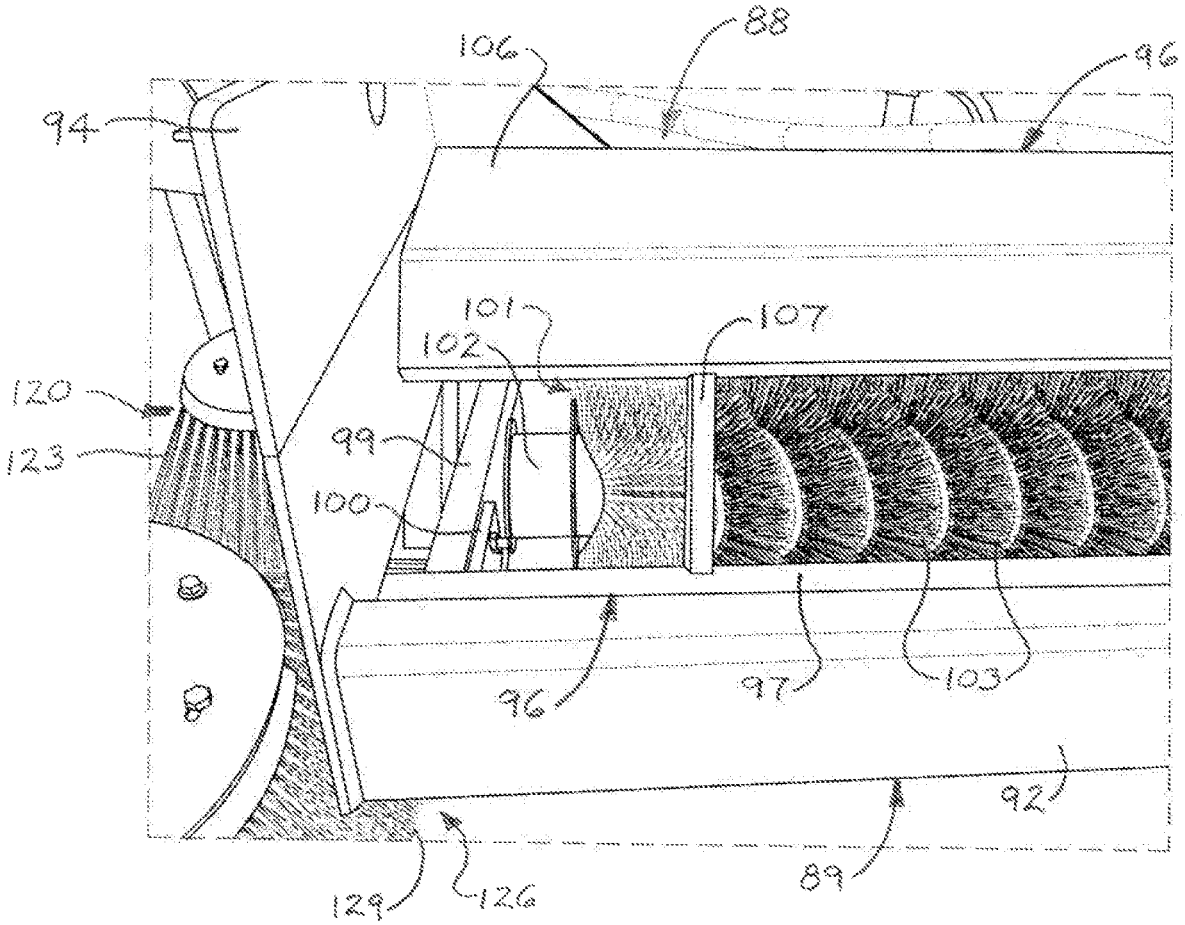
FIG. 14 is a rear sectional perspective view of the directing broom assembly.
Figure 15:
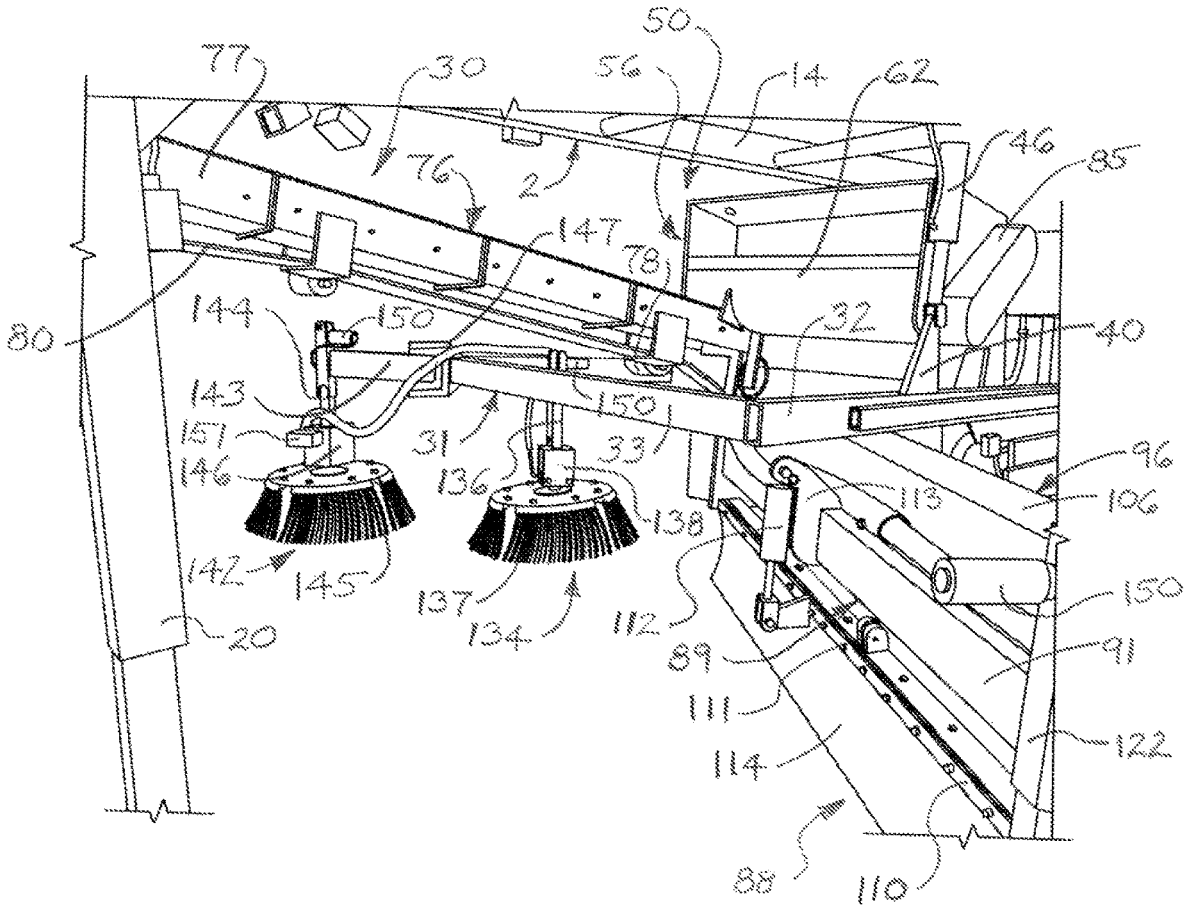
FIG. 15 is a front perspective view of the directing broom assembly and a right side edge broom assembly and a right side curb broom assembly deployed in the functional configuration.

As particularly illustrated in FIG. 14, a broom shield 106 may extend over the directing broom 101. Multiple broom shield supports 107 may attach the broom shield 106 to the broom mount frame 96.

Figure 10:
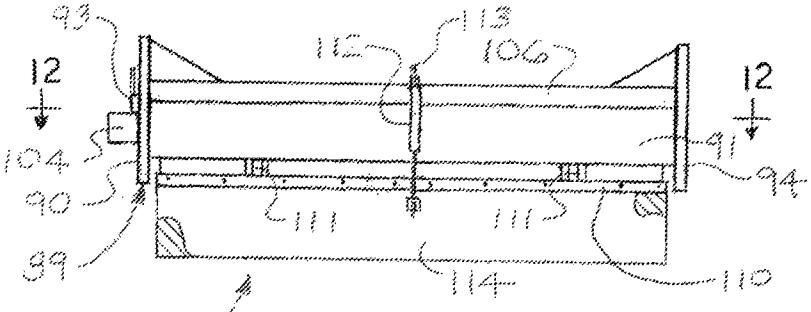
FIG. 10 is a front view of the directing broom assembly.

As illustrated in FIGS. 7, 8 and 10, in some embodiments, at least one directing broom actuator 112, which may be hydraulic, pneumatic or electric, may extend from the directing broom assembly frame 89 and attach to the broom mount frame 96 to facilitate selective raising and lowering of the broom mount frame 96 and directing broom 101 in the directing broom assembly frame 89. In some embodiments, the directing broom actuator 112 may include at least one up-down float cylinder. A broom mount frame extension 110 may extend from the broom mount frame 96. An actuator mount flange 113 may extend from the front frame member 91 of the directing broom assembly frame 89. The directing broom actuator 112 may be attached to the actuator mount flange 113 and to the broom mount frame extension 110. Accordingly, actuation of the directing broom actuator 112 may facilitate selective raising and lowering of the broom mount frame 96 and directing broom 101 in the directing broom assembly frame 89. At least one roller bearing 111 may be provided on the broom mount frame extension 110 in engagement with the front frame member 91 of the directing broom assembly frame 89 for stabilization purposes. As further illustrated in FIGS. 7 and 8, a flexible broom flap 114 may extend downwardly from the broom mount frame extension 110.

As further illustrated in FIG. 23, in some embodiments, in the functional configuration of the sweeper assembly 30, the front frame member 91 of the directing broom assembly frame 89 may face the longitudinal midline axis 26 of the apparatus frame 2. The longitudinal broom axis 95 of the directing broom 101 may be disposed at a directing broom angle 108 of from about 25 degrees to about 30 degrees with respect to the longitudinal midline axis 26 of the apparatus frame 2, depending typically on the width of the road surface 190. In typical application, the pavement milling machine 170 may have an operating width of typically at least 10', and most typically 10'-14'. In some embodiments or applications, the apparatus 1 may have a sweep width of 10'-15' in one forward pass or motion.

As further illustrated in FIGS. 22 and 23, the left side edge broom assembly 120 may include a left side edge broom assembly arm 121 which may extend from the directing broom assembly frame 89 of the directing broom assembly 88. In some embodiments, the left side edge broom assembly arm 121 may extend from the front frame member 91 at or adjacent to the outer frame plate 94. The left side edge broom assembly arm 121 may be welded and/or otherwise attached to the directing broom assembly frame 89 in perpendicular relationship with the longitudinal broom axis 95 of the directing broom 101.

As illustrated in FIGS. 7 and 8, a left side edge broom mount member 122 may extend downwardly from the left side edge broom assembly arm 121. A circular left side edge broom 123 may terminate the lower end of the left side edge broom assembly arm 121. A left side edge broom motor 124, which may be hydraulic, may be provided on the left side edge broom mount member 122. The left side edge broom motor 124 may drivingly engage the left side edge broom 123 for rotation according to the knowledge of those skilled in the art.

In some embodiments, the left side edge broom mount member 122 may be adjustable in length. Accordingly, the left side edge broom mount member 122 may be telescopically-adjustable. For example and without limitation, in some embodiments, the left side edge broom mount member 122 may include a 2½ outer tubing with a 2" inner tubing which is extendable from and retractable into the outer tubing. A vertical broom adjustment motor 150, which may be electric or hydraulic or pneumatic, may operably engage the telescoping left side edge broom mount member 122, such as through a worm gear (not illustrated) or the like, to facilitate selective extension and retraction of the left side edge broom mount member 122 and raising and lowering of the left side edge broom 123 for purposes which will be hereinafter described. An adjustment motor control 151 may operably interface with the vertical broom adjustment motor 150. The adjustment motor control 151 may be provided on the left side edge broom assembly arm 121, the left side edge broom mount member 122 or in any other accessible location. In some embodiments, the adjustment motor control 151 may include a toggle switch. In some embodiments, the adjustment motor control 151 may be included as part of at least one controller 212 (FIG. 38) of an apparatus control system 200, which will be hereinafter described.

As illustrated in FIGS. 23, 25 and 26, in the functional configuration of the apparatus 1, the left side edge broom 123 may be disposed outwardly and in front or in the directing broom sweep path 105 of the directing broom 101. In some embodiments, the left side edge broom sweep path 125 of the left side edge broom 123 may at least partially overlap the directing broom sweep path 105 of the directing broom 101.

As further illustrated in FIGS. 22 and 23, the left side curb broom assembly 126 may include a left side curb broom assembly arm 127 which may extend from the directing broom assembly frame 89. In some embodiments, the left side curb broom assembly arm 127 may extend from the outer end of the front frame member 91 which may protrude beyond the outer frame plate 94 of the directing broom assembly frame 89. A left side curb broom hinge 131 may pivotally connect the left side curb broom assembly arm 127 to the front frame member 91.

As illustrated in FIGS. 7 and 9, a left side curb broom mount member 128 may extend downwardly from the left side curb broom assembly arm 127. A circular left side curb broom 129 may terminate the lower end of the left side curb broom assembly arm 127. A left side curb broom motor 130, which may be hydraulic, may be provided on the left side curb broom mount member 128. The left side curb broom motor 130 may drivingly engage the left side curb broom 129 for rotation according to the knowledge of those skilled in the art.

In some embodiments, the left side curb broom mount member 128 may be adjustable in length. Accordingly, the left side curb broom mount member 128 may be telescopically-adjustable. For example and without limitation, in some embodiments, the left side curb broom mount member 128 may include a 2½" outer tubing with a 2" inner tubing which is extendable from and retractable into the outer tubing. A vertical broom adjustment motor 150, which may be electric, hydraulic or pneumatic, may operably engage the telescoping left side curb broom mount member 128, such as through a worm gear (not illustrated) or the like, to facilitate selective extension and retraction of the left side curb broom mount member 128 and raising and lowering of the left side curb broom 129 for purposes which will be hereinafter described. An adjustment motor control 151 may operably interface with the vertical broom adjustment motor 150. The adjustment motor control 151 may be provided on the left side curb broom assembly arm 127, the left side curb broom mount member 128 or in any other accessible location. In some embodiments, the adjustment motor control 151 may be included as part of the controller 212 (FIG. 38) of the apparatus control system 200.

The left side curb broom assembly arm 127 may be pivotal between the folded, storage or transport configuration illustrated in FIG. 22 and the extended, functional configuration illustrated in FIG. 23. In the transport configuration (FIG. 22), the left side curb broom 129 may be disposed adjacent to the outer frame plate 94 of the directing broom assembly frame 89 and in outward, spaced-apart relationship to the left side edge broom 123. In the functional configuration (FIG. 23), the left side curb broom 129 may be disposed away from the directing broom assembly frame 89, outwardly and adjacent and forwardly with respect to the left side edge broom 123. In some embodiments, a broom positioning actuator (not illustrated), which may be hydraulic, pneumatic or electric, may be provided on the directing broom assembly frame 89 and may attach to the left side curb broom assembly arm 127 to facilitate pivoting of the left side curb broom assembly arm 127 between the folded, transport or storage configuration (FIG. 22) and the extended, functional configuration (FIG. 23).

As illustrated in FIGS. 23, 25 and 26, in the functional configuration of the apparatus 1, the left side curb broom 129 may be disposed outwardly, elevated with respect to and slightly to the front of the left side edge broom 123.

As illustrated in FIGS. 3, 4, 15, 16, 22 and 23, the right side edge broom assembly 134 may include a right side edge broom assembly arm 135 which may extend from the broom mount frame 36. In some embodiments, a right side edge broom hinge 139 may pivotally attach the right side edge broom assembly arm 135 to the transverse mount frame member 38 of the broom mount frame 36 typically adjacent to the side assembly frame member 32 of the sweeper assembly frame 31. A broom positioning actuator 140, which may be hydraulic, pneumatic or electric, may be provided on the longitudinal mount frame member 37 of the broom mount frame 36 and may attach to the right side edge broom assembly arm 135 to selectively deploy the right side edge broom assembly 134 between the transport configuration (FIG. 22) and the functional configuration (FIG. 23).

Figure 16:
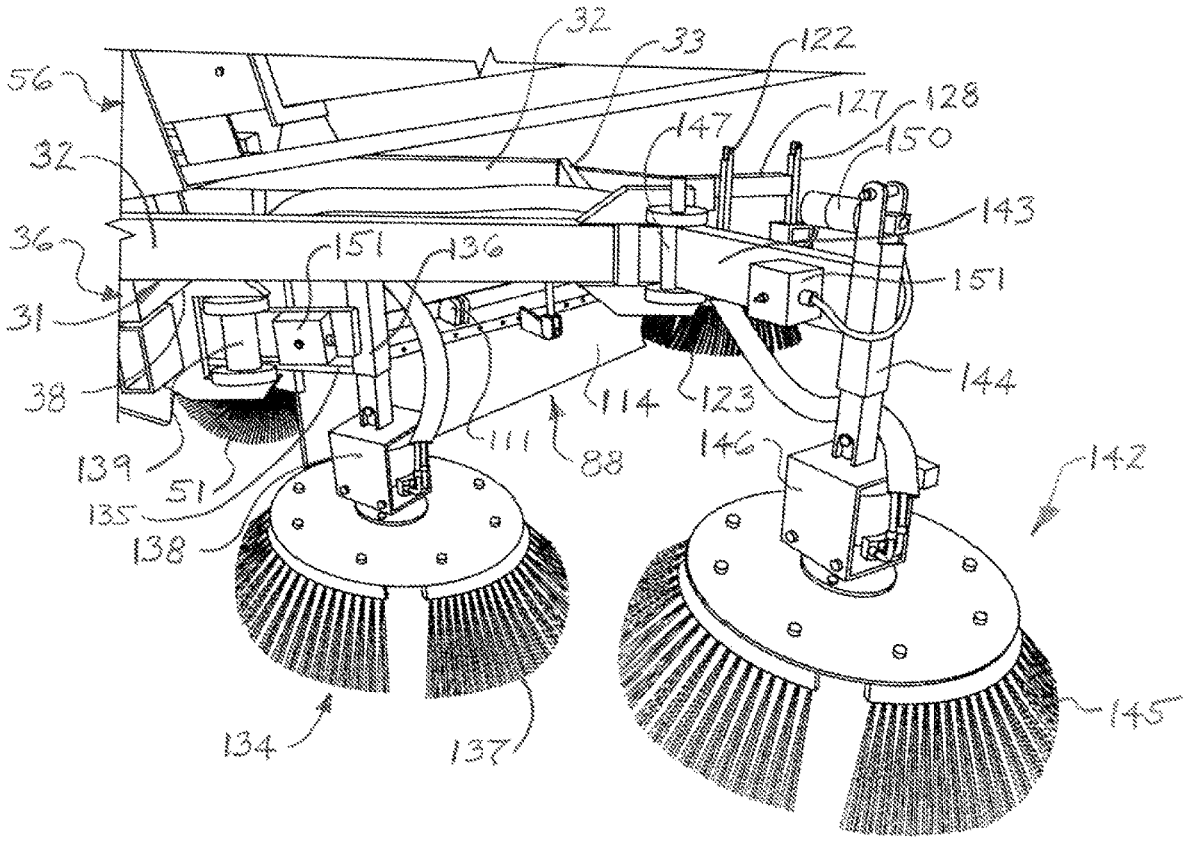
FIG. 16 is a perspective view of the right side edge broom assembly and the right side curb broom assembly in the functional configuration.

As illustrated in FIG. 16, a right side edge broom mount member 136 may extend downwardly from the right side edge broom assembly arm 135. A circular right side edge broom 137 may terminate the lower end of the right side edge broom assembly arm 135. A right side edge broom motor 138, which may be hydraulic, may be provided on the right side edge broom mount member 136. The right side edge broom motor 138 may drivingly engage the right side edge broom 137 for rotation according to the knowledge of those skilled in the art.

In some embodiments, the right side edge broom mount member 136 may be adjustable in length. Accordingly, the right side edge broom mount member 136 may be telescopically-adjustable. For example and without limitation, in some embodiments, the right side edge broom mount member 136 may include a 2½" outer tubing with a 2" inner tubing which is extendable from and retractable into the outer tubing. A vertical broom adjustment motor 150, which may be electric, hydraulic or pneumatic, may operably engage the telescoping right side edge broom mount member 136, such as through a worm gear (not illustrated) or the like, to facilitate selective extension and retraction of the right side edge broom mount member 136 and raising and lowering of the right side edge broom 137 for purposes which will be hereinafter described. An adjustment motor control 151 may operably interface with the vertical broom adjustment motor 150. The adjustment motor control 151 may be provided on the right side edge broom assembly arm 135, the right side edge broom mount member 136 or in any other accessible location. In some embodiments, the adjustment motor control 151 may be included as part of the controller 212 (FIG. 38) of the apparatus control system 200.

In some embodiments, each of the left side edge broom 123, left side curb broom 129, right side edge broom 137 and right side curb broom 145 may have an initial diameter of about 42" and a worn diameter of about 36". Each of the pickup broom 51 and the directing broom 101 may have a diameter of from about 32" to about 42". In some embodiments, the directing broom 101 may have a length of about 8' and may have a diameter of about 35" when new. The pickup broom 51 may have a length of about 5' and may have a diameter of about 35" when new.

As illustrated in FIGS. 23, 25 and 26, in the functional configuration of the apparatus 1, the right side edge broom sweep path 141 of the right side edge broom 137 may be disposed outwardly and in front of the pickup unit sweep path 61 of the pickup broom 51. In some embodiments, the right side edge broom sweep path 141 of the right side edge broom 137 may at least partially overlap the pickup unit sweep path 61 of the pickup broom 51.

As illustrated in FIGS. 15, 16, 22 and 23, the right side curb broom assembly 142 may include a right side curb broom assembly arm 143 which may extend from the sweeper assembly frame 31. In some embodiments, a right side curb broom hinge 147 may pivotally attach the right side curb broom assembly arm 143 to the front assembly frame member 33 of the sweeper assembly frame 31 typically at or adjacent to the side assembly frame member 32. In some embodiments, a broom positioning actuator (not illustrated), which may be hydraulic, pneumatic or electric, may be provided on the sweeper assembly frame 31 and may attach to the right side curb broom assembly arm 143 to selectively deploy the right side curb broom assembly 142 between the transport configuration (FIG. 22) and the functional configuration (FIG. 23).

As further illustrated in FIG. 16, a right side curb broom mount member 144 may extend downwardly from the right side curb broom assembly arm 143. A circular right side curb broom 145 may terminate the lower end of the right side curb broom assembly arm 143. A right side curb broom motor 146, which may be hydraulic, may be provided on the right side curb broom mount member 144. The right side curb broom motor 146 may drivingly engage the right side curb broom 145 for rotation according to the knowledge of those skilled in the art.

In some embodiments, the right side curb broom mount member 144 may be adjustable in length. Accordingly, the right side curb broom mount member 144 may be telescopically-adjustable. For example and without limitation, in some embodiments, the right side curb broom mount member 144 may include a 2½" outer tubing with a 2" inner tubing which is extendable from and retractable into the outer tubing. A vertical broom adjustment motor 150, which may be electric, hydraulic or pneumatic, may operably engage the telescoping right side curb broom mount member 144, such as through a worm gear (not illustrated) or the like, to facilitate selective extension and retraction of the right side curb broom mount member 144 and raising and lowering of the right side curb broom 144 for purposes which will be hereinafter described. An adjustment motor control 151 may operably interface with the vertical broom adjustment motor 150. The adjustment motor control 151 may be provided on the right side curb broom assembly arm 143, the right side curb broom mount member 144 or in any other accessible location. In some embodiments, the adjustment motor control 151 may be included as part of the controller 212 (FIG. 38) of the apparatus control system 200.

As illustrated in FIG. 23, in the functional configuration of the apparatus 1, the left side curb broom 145 may be disposed outwardly, elevated with respect to and in front of the right side edge broom 137.

In some embodiments each of the left side edge broom 123, the left side curb broom 129, the right side edge broom 137 and the right side curb broom 145 may be selectively adjustable to a desired sweep angle with respect to the corresponding left side edge broom mount member 122, left side curb broom mount member 128, right side edge broom mount member 136 and right side curb broom mount member 144 typically as will be hereinafter described.

Figure 17:
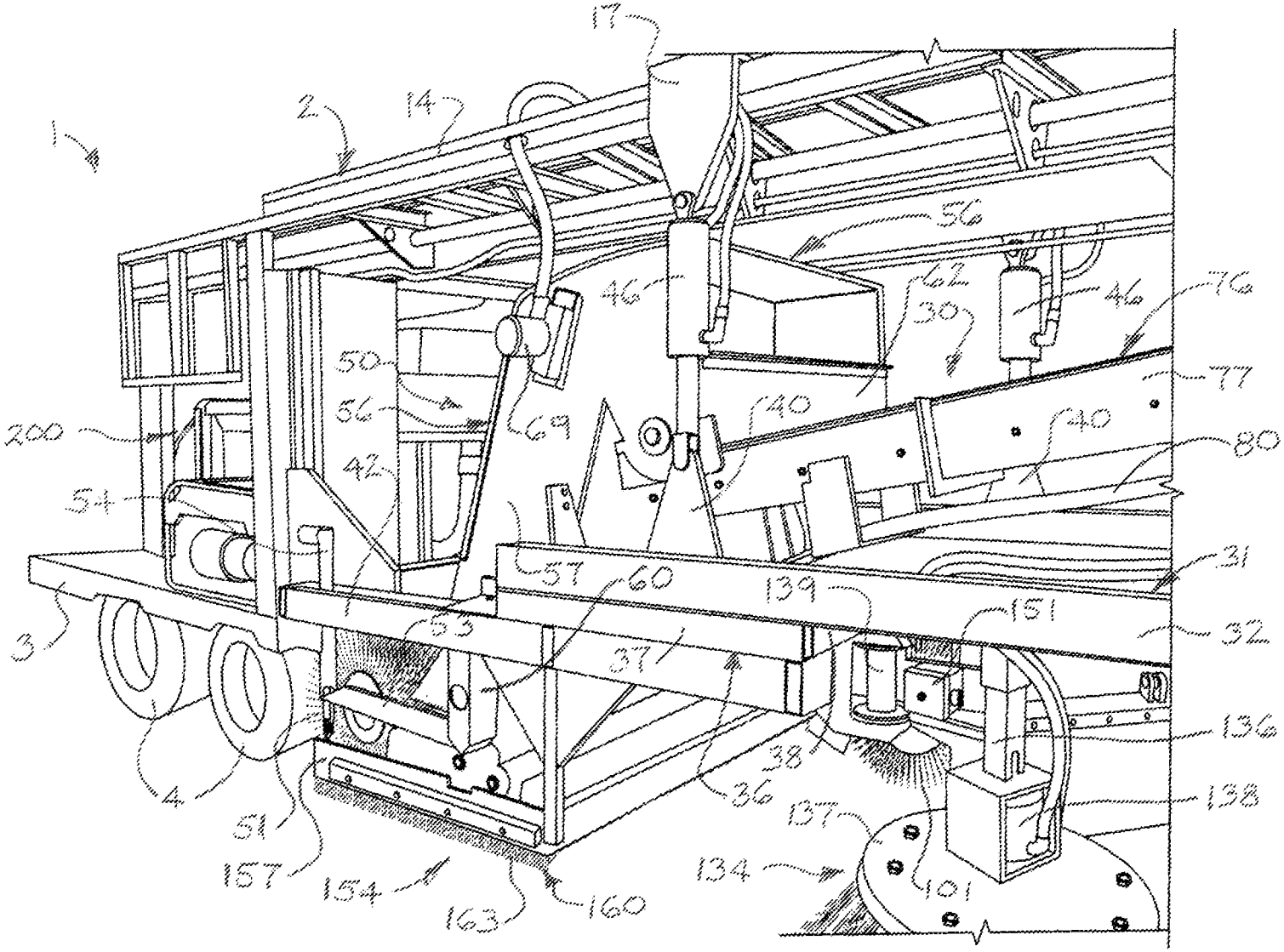
FIG. 17 is a typical front right side perspective view of the pavement sweeping apparatus, more particularly illustrating an exemplary pickup unit of the apparatus.
Figure 18:
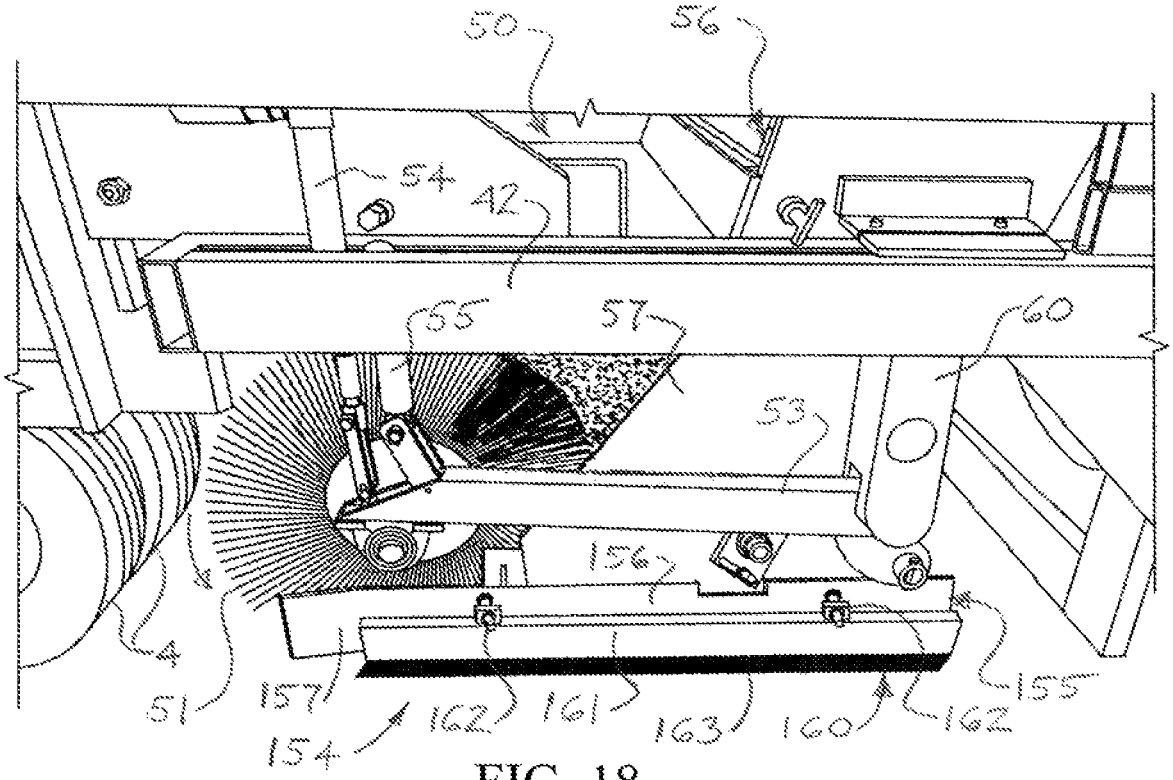
FIG. 18 is a side view of a typical curb shoe assembly adjacent to the pickup unit on the apparatus.
Figure 19:
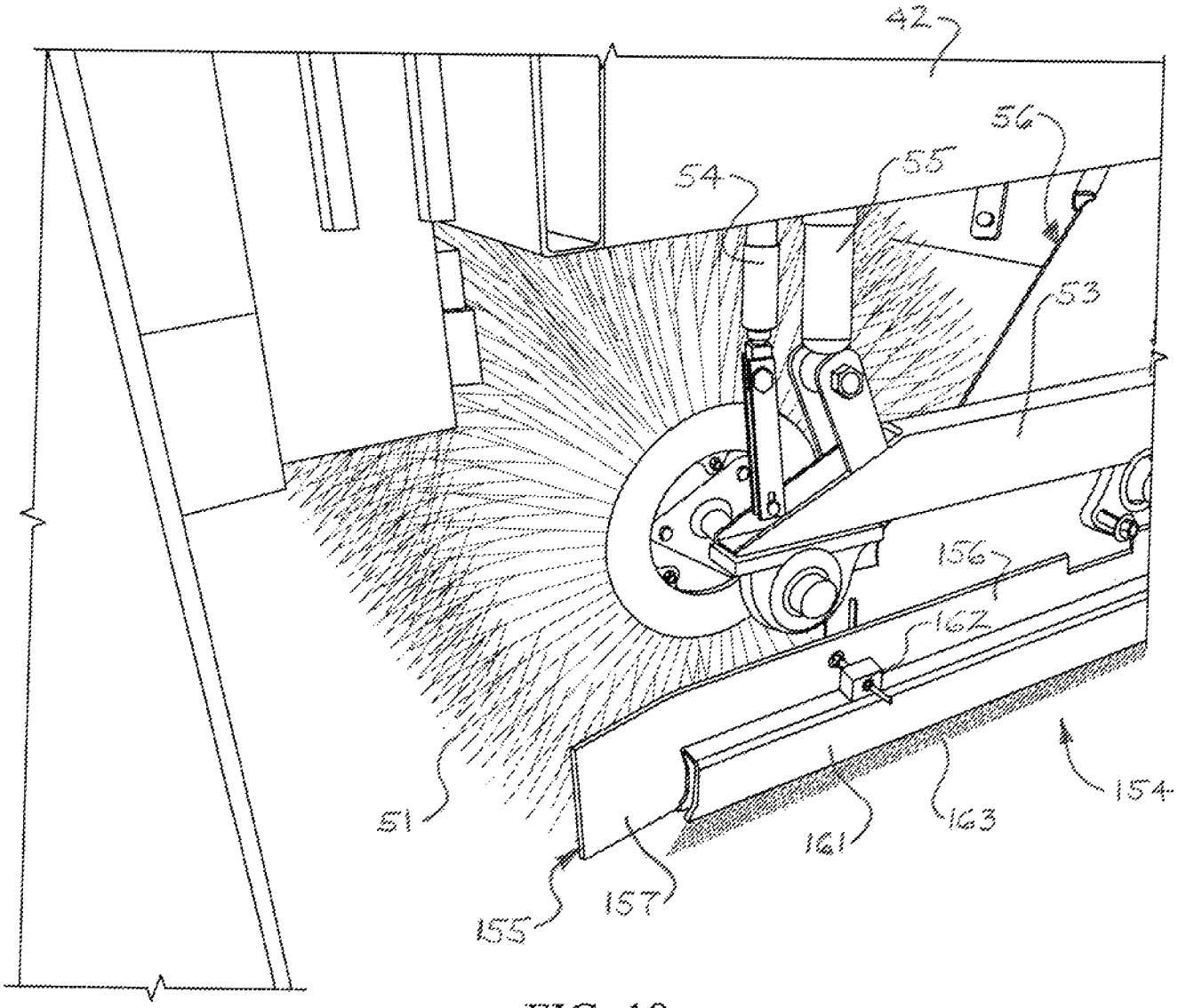
FIG. 19 is a rear perspective view of the curb shoe assembly illustrated in FIG. 18.
Figure 20:
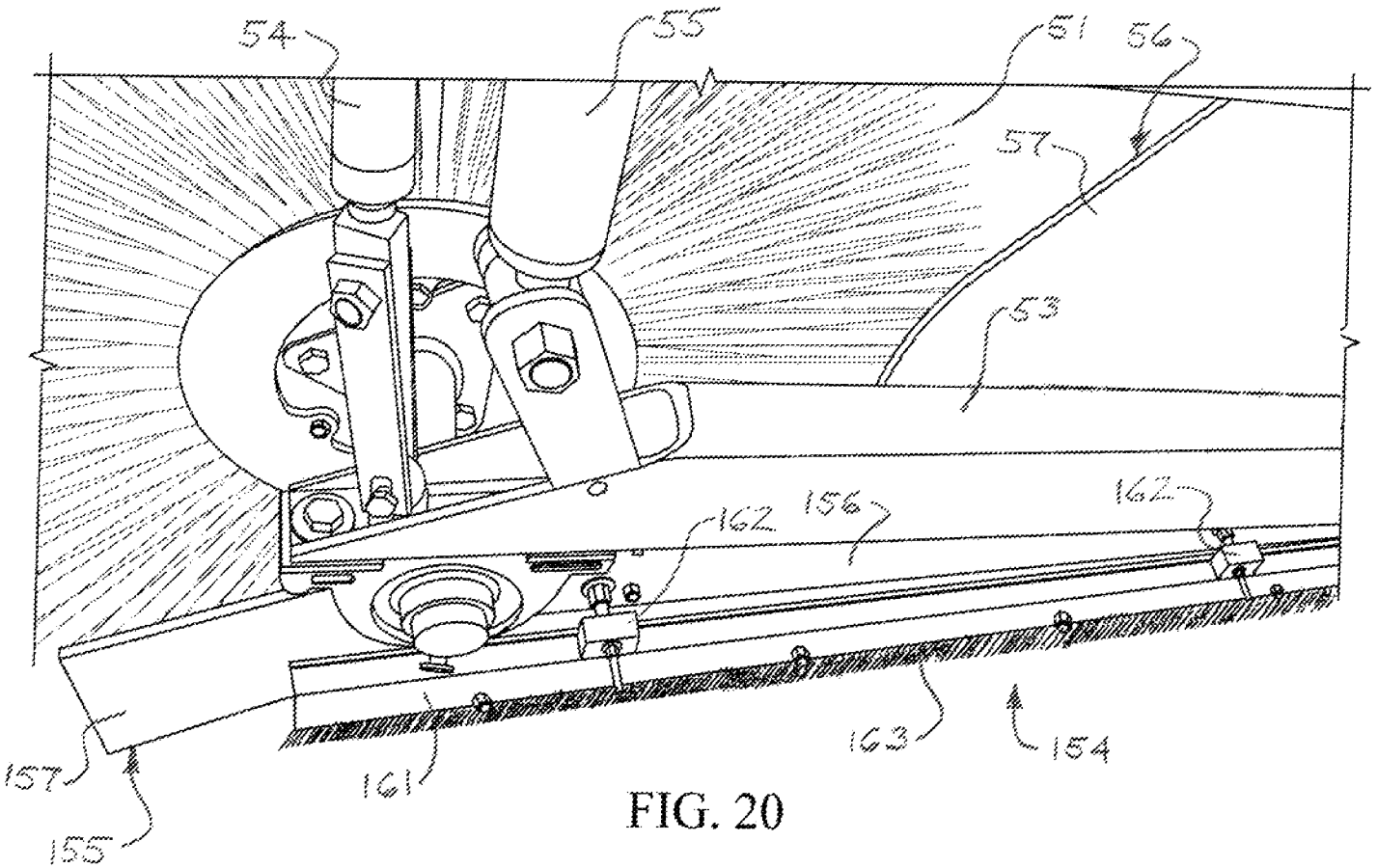
FIG. 20 is a side perspective view of the curb shoe assembly.
Figure 21:
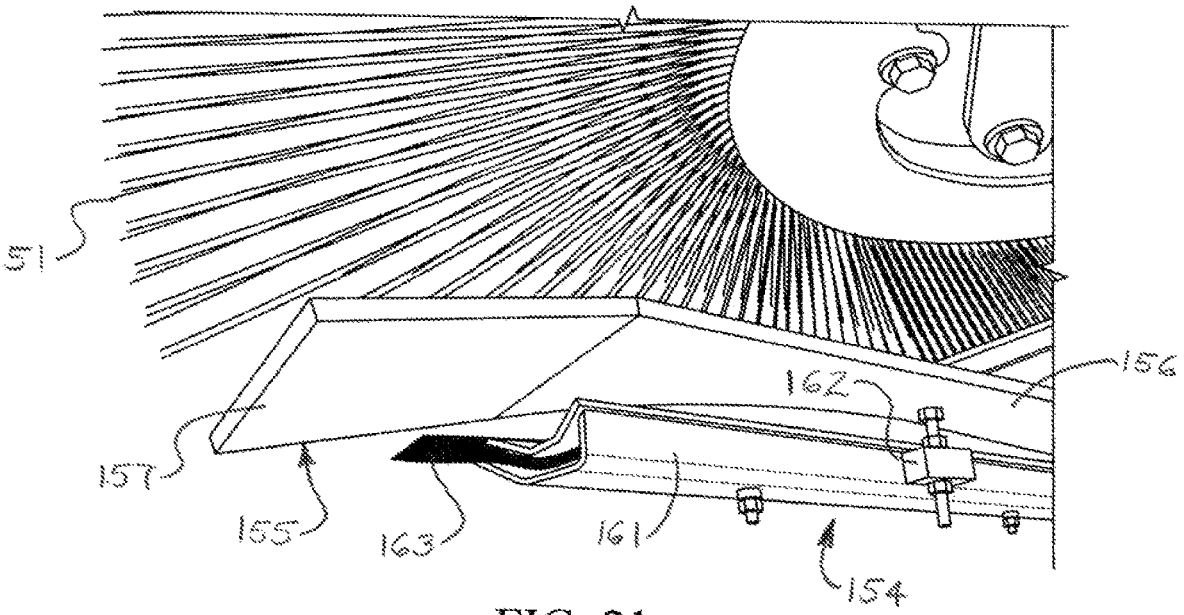
FIG. 21 is an enlarged rear perspective view of the curb shoe assembly.

Referring next to FIGS. 3, 4, 15, 17, 18, 22, 23, 27 and 28 of the drawings, the pickup unit 50 of the sweeper assembly 30 may include at least one pickup broom 51. The pickup broom 51 may be elongated and cylindrical and may be mounted for rotation on the sweeper assembly frame 31 according to the knowledge of those skilled in the art. As illustrated in FIG. 17, in some embodiments, a pair of arm mount members 60 (one of which is illustrated) may extend downwardly from the respective pickup unit support members 42 of the sweeper assembly frame 31. An elongated pickup broom mount arm 53 may extend rearwardly from each arm mount member 60. The pickup broom 51 may be journaled for rotation between the pickup broom mount arms 53 according to the knowledge of those skilled in the art. In some embodiments, at least one pickup broom actuator 54, which may be hydraulic, pneumatic or electric, may be provided on the corresponding pickup unit support member 42. The pickup broom actuator 54 may attach to the corresponding pickup broom mount arm 53 to facilitate selective raising and lowering of the pickup broom 51 for purposes which will be hereinafter described. As illustrated in FIG. 18, in some embodiments, at least one shock absorber 55 may extend from at least one of the pickup unit support members 42 and attach to the corresponding pickup broom mount arm 53 for shock absorbing purposes.

As illustrated in FIG. 23, in the functional configuration of the apparatus 1, the pickup broom 51 may be disposed behind and to the right side of the directing broom 101. The directing broom sweep path 105 of the directing broom 101 may at least partially overlap the pickup unit sweep path 61 of the pickup broom 51.

Figure 27:
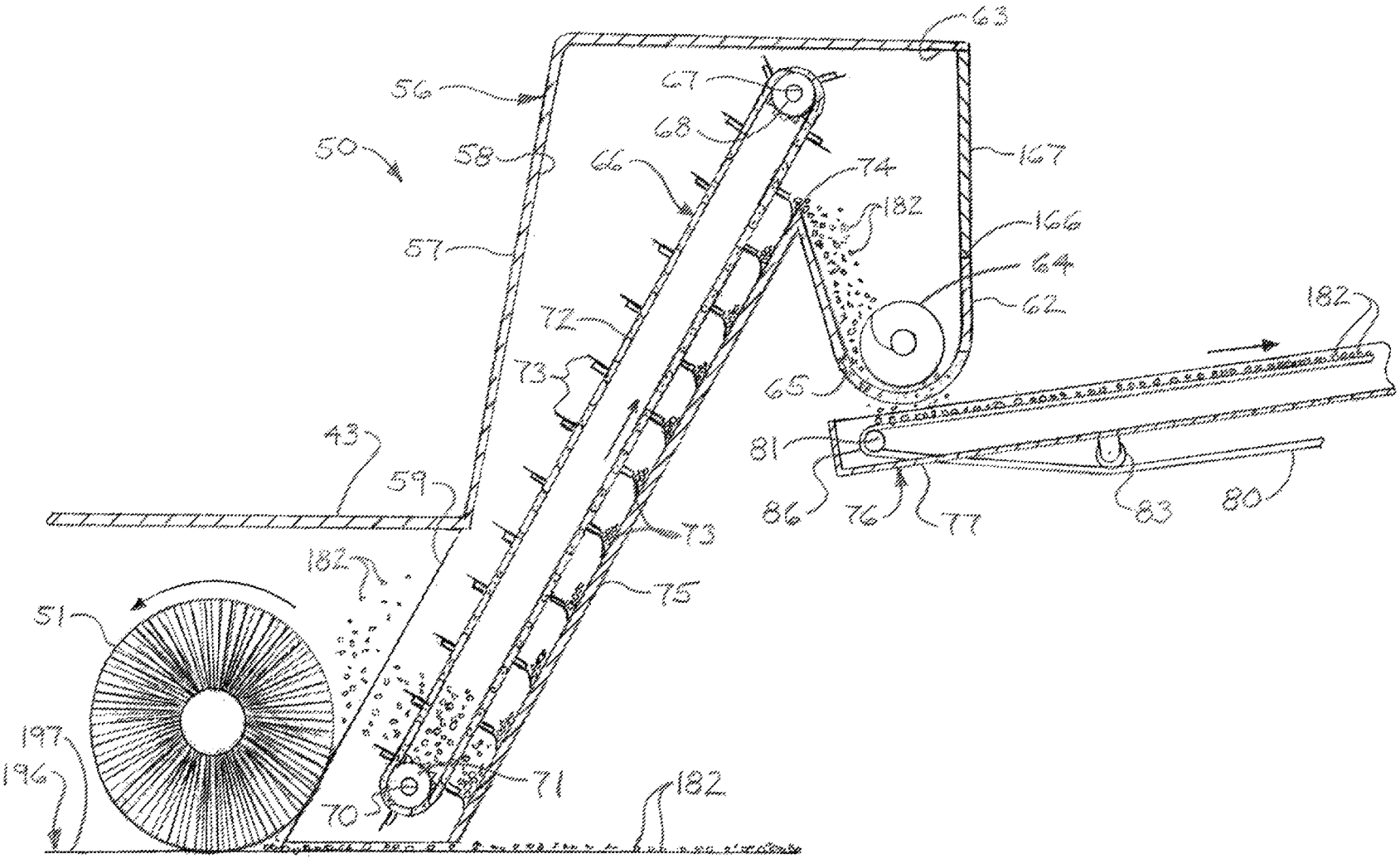
FIG. 27 is a cross-sectional side view of a typical pickup unit of the apparatus in typical pickup of the milling particles from the milled pavement in application of the apparatus.
Figure 28:
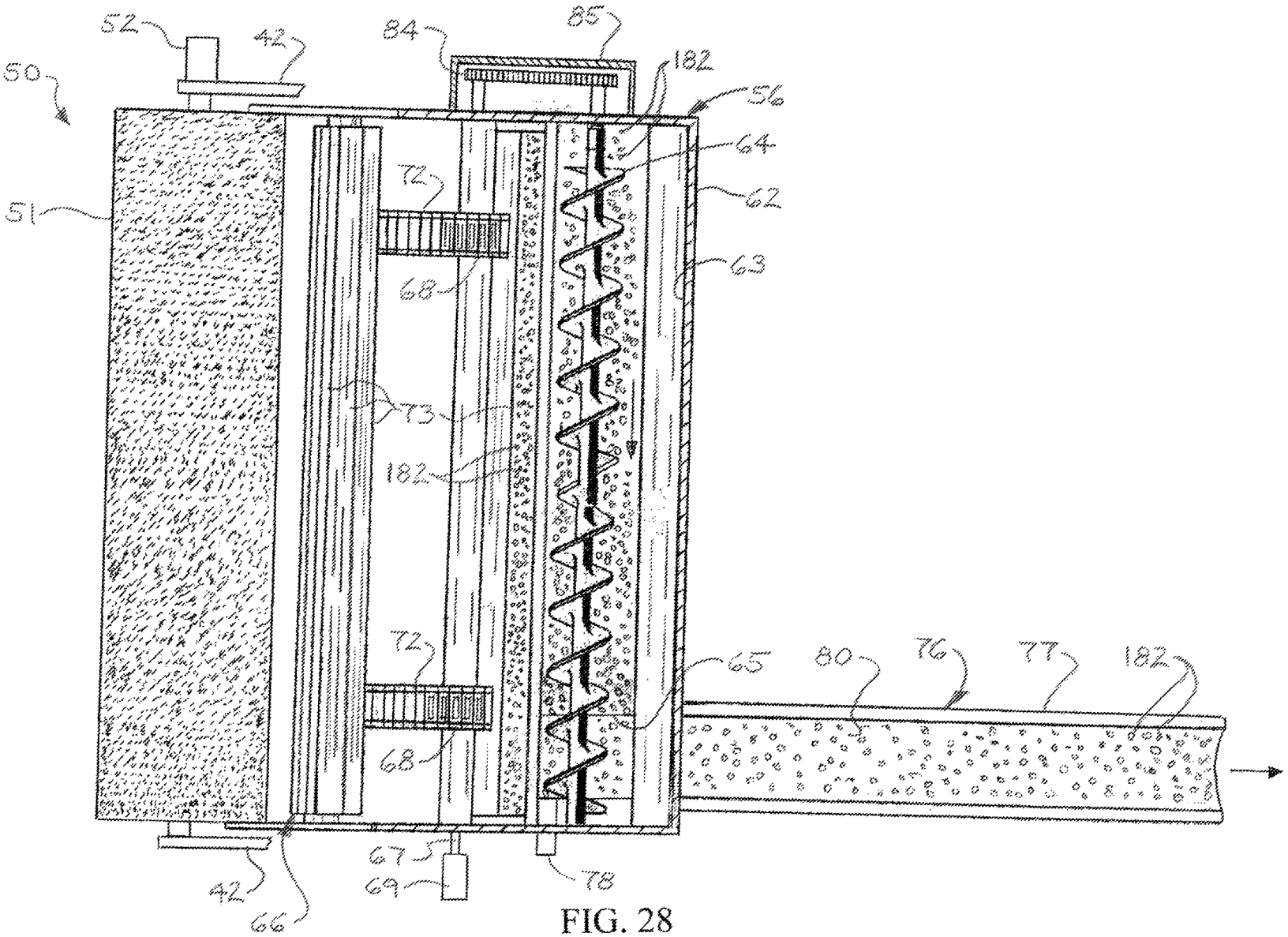
FIG. 28 is a cross-sectional top view of the pickup unit.

At least one pickup unit housing 56 may be provided on the sweeper assembly frame 31 in front of the pickup broom 51. As illustrated in FIG. 27, the pickup unit housing 56 may include an intake portion 57 having an intake portion interior 58 and an angled or sloped front housing wall 75. The intake portion 57 may have an intake opening 59 which communicates with the intake portion interior 58 and is disposed immediately in front of the pickup broom 51. A transfer portion 62 may extend forwardly from the intake portion 57 of the pickup unit housing 56. The transfer portion 62 may have a transfer portion interior 63 which communicates with the intake portion interior 58 of the intake portion 57 typically through a communication interface 74. At least one discharge opening 65 may be provided in a lower portion of the transfer portion 62. As illustrated in FIG. 28, in some embodiments, the discharge opening 65 may be disposed at an outer or right side end of the transfer portion interior 63. In other embodiments, the discharge opening 65 may be disposed at a left side end, in the middle or in any other position in the transfer portion interior 63 depending typically on the desired position or trajectory of the sweeper conveyor assembly 76. In some embodiments, at least one access opening 166 may be provided in the front wall of the transfer portion 62. At least one openable access door 167 may normally close the access opening 166.

At least one pickup elevator assembly 66 may be provided in the intake portion interior 58 of the pickup unit housing 56. The pickup elevator assembly 66 may include a drive shaft 67 which may be disposed in the upper portion of the intake portion interior 58 typically at the communication interface 74 between the transfer portion interior 63 and the intake portion interior 58. At least one drive sprocket 68 may be provided on the drive shaft 67. As illustrated in FIG. 28, a pickup elevator drive motor 69, which may be hydraulic, pneumatic or electric, may drivingly engage the drive shaft 67 for rotation. Accordingly, the pickup elevator drive motor 69 may facilitate rotation of the pickup chain 72 around the drive sprocket 68 and the idle sprocket 71 in the counterclockwise direction illustrated in FIG. 27.

An idle shaft 70 may be disposed in the lower portion of the intake portion interior 58 typically in front of the intake opening 59. At least one idle sprocket 71 may be provided on the idle shaft 70. At least one pickup chain 72 may mesh with the corresponding drive sprocket 68 and idle sprocket 71. Multiple, elongated, flexible, typically rubber pickup slats 73 may be provided on the pickup chains 72 typically in parallel, spaced-apart relationship to each other. Each pickup slat 73 may be attached to each pickup chain 72 using suitable brackets and mechanical fasteners (not illustrated) according to the knowledge of those skilled in the art. On the rear run of the pickup chain 72, the pickup slats 73 may extend outwardly from the pickup chain 72. On the forward run of the pickup chain 72, an outer edge of each pickup slat 73 may engage the interior surface of the front housing wall 75 and assume a curved, downwardly-deformed or flexed configuration as they apply a squeegee effect to the front housing wall 75.

As further illustrated in FIG. 27, as the pickup elevator drive motor 69 (FIG. 28) rotates the drive shaft 67 and the drive sprockets 68, the pickup chains 72 may traverse the respective drive sprockets 68 and idle sprockets 71 such that the pickup chain 72 lowers the pickup slats 73 on the rear run of the pickup chain 72, which is closer to the intake opening 59, and raises the pickup slats 73 on the front run of the pickup chain 72, which is opposite the intake opening 59 and adjacent to the front housing wall 75. Accordingly, the rising and downwardly-deformed or flexed pickup slats 73 may apply a squeegee effect to the interior surface of the front housing wall 75 as the pickup chains 72 traverse the drive shaft sprocket 68 and the idle sprocket 71 responsive to operation of the pickup elevator drive motor 69. As they subsequently reach and move beyond the communication interface 74, the pickup slats 73 may recoil back to and remain in the straight, non-flexed configuration on their downward course on the rear run of the pickup chain 72 until they subsequently again traverse the idle sprocket 71 and engage the lower portion of the front housing wall 75.

As illustrated in FIGS. 27 and 28, at least one transfer auger 64 may be journaled for rotation in the transfer portion interior 63 of the transfer portion 62. As illustrated in FIG. 28, in some embodiments, the transfer auger 64 may be drivingly coupled to the drive shaft 67 through a suitable drive coupling 84 which may be exterior to the pickup unit housing 56. A drive coupling cover 85 may enclose the drive coupling 84. Accordingly, as the pickup elevator drive motor 69 rotates the drive shaft 67, the drive coupling 84 may transmit rotation from the drive shaft 67 to the transfer auger 64 such that the blades of the transfer auger 64 progress toward the discharge opening 65.

In typical operation of the apparatus 1, which will be hereinafter described, the pickup broom 51 may rotate in the counterclockwise direction, as indicated by the arrow in FIG. 27, such that the pickup broom 51 throws the milling particles 182 from the bottom mill cut surface 197 of the mill cut 196 upwardly and forwardly through the intake opening 59 and onto the rising pickup slats 73 of the pickup elevator assembly 66. As the pickup chain 72 traverses the drive shaft sprocket 68, the squeegeed pickup slats 73 may trap and raise the milling particles 182 against the interior surface of the front housing wall 75 and then discharge the milling particles 182 through the communication interface 74 into the transfer portion interior 63 of the transfer portion 62 as the pickup slats 73 traverse the communication interface 74. As illustrated in FIG. 28, the rotating transfer auger 64 may transfer the milling particles 182 toward and then through the discharge opening 65 for purposes which will be hereinafter described.

It will be recognized and understood that the pickup elevator assembly 66 which is heretofore described with respect to FIG. 27 is a non-limiting example of a system which is suitable for removing the milling particles 182 from the bottom mill cut surface 197 of the mill cut 196. Alternative mechanisms known by those skilled in the art, including but not limited to vacuum systems, may be used instead of or in addition to the pickup elevator assembly 66.

Figure 29:
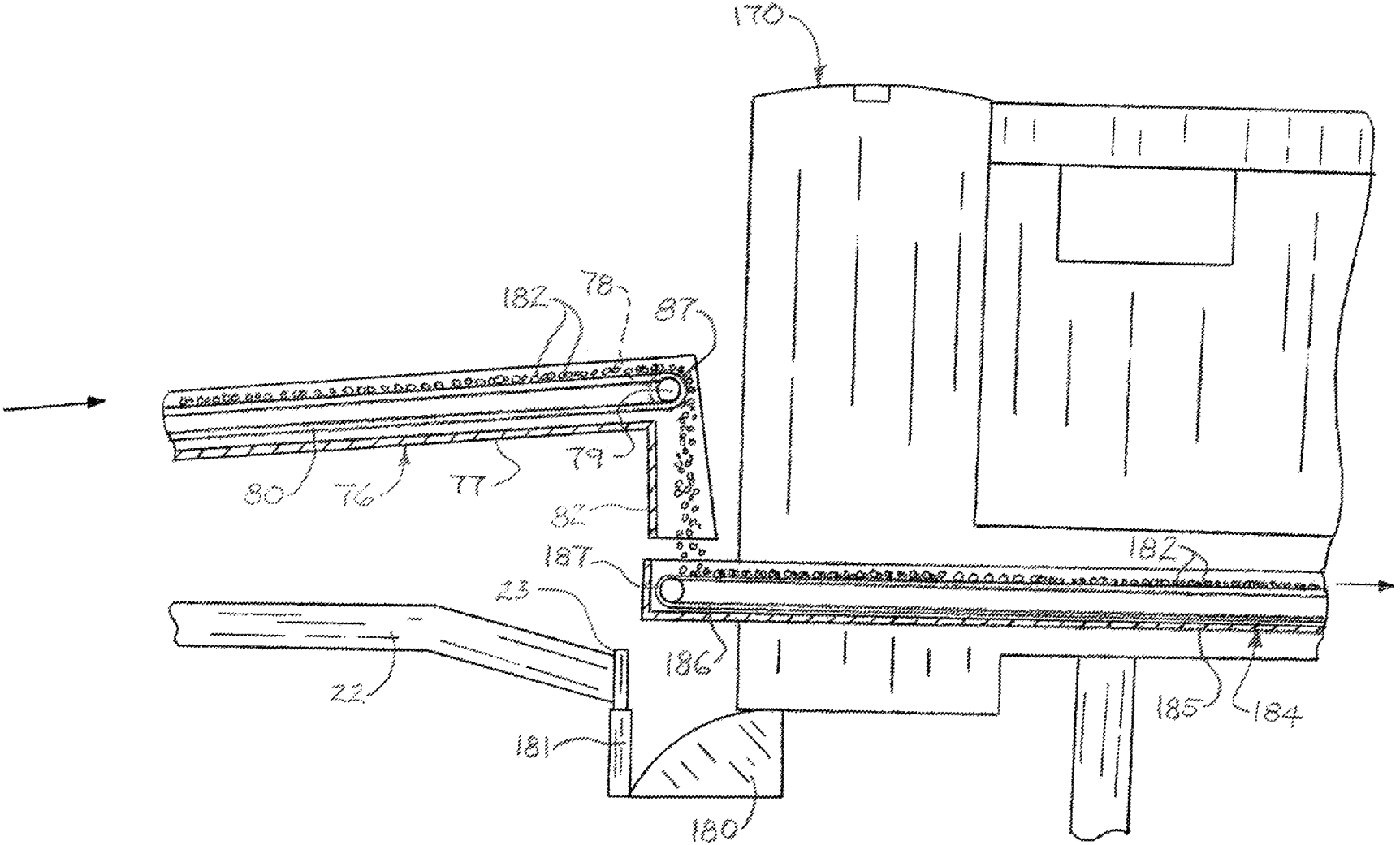
FIG. 29 is a side view, partially in section, of a sweeper conveyor assembly of the apparatus deployed in position above a primary conveyor assembly on the pavement milling or cold planing machine, more particularly illustrating typical discharge of the milling particles after pickup from the sweeper conveyor assembly onto the primary conveyor assembly.

Referring next to FIGS. 27-30 of the drawings, at least one sweeper conveyor assembly 76 may transport the milling particles 182 from the pickup unit 50 to the pavement milling machine 170 (FIG. 29). In some embodiments, the sweeper conveyor assembly 76 may include an elongated conveyor assembly frame 77. As illustrated in FIG. 29, a conveyor assembly discharge portion 82 may extend from the conveyor assembly frame 77. A conveyor assembly drive roller 79 may be provided in the conveyor assembly frame 77 of the sweeper conveyor assembly 76. A conveyor assembly motor 78, which may be electric, hydraulic or pneumatic, may drivingly engage the conveyor assembly drive roller 79.

At least one conveyor assembly idle roller 81 (FIG. 27) and at least one intermediate roller 83 may be provided in the conveyor assembly frame 77. A sweeper conveyor assembly conveyor belt 80 may engage the conveyor assembly drive roller 79, the conveyor assembly idle roller 81 and the intermediate roller or rollers 83. The sweeper conveyor assembly conveyor belt 80 may have a sweeper conveyor assembly conveyor belt loading end 86 (FIG. 27) and a sweeper conveyor assembly conveyor belt discharge end 87 (FIG. 29). Accordingly, in typical application of the apparatus 1, which will be hereinafter described, responsive to operation of the conveyor assembly motor 78, the conveyor assembly drive roller 79 may drive the upper run of the sweeper conveyor assembly conveyor belt 80 forwardly toward the pavement milling machine 170, in the direction indicated by the arrow in FIG. 27. The milling particles 182 may be discharged from the transfer portion 62 of the pickup unit housing 56 through the discharge opening 65 and onto the sweeper conveyor assembly conveyor belt loading end 86 of the sweeper conveyor assembly conveyor belt 80, which may carry or transport the milling particles 182 to the conveyor assembly discharge portion 82 at the sweeper conveyor assembly conveyor belt discharge end 87 of the sweeper conveyor assembly conveyor belt 80 and then to the pavement milling machine 170, typically as will be hereinafter described.

As illustrated in FIGS. 29 and 30, the pavement milling machine 170 may include an elongated primary conveyor assembly 184. The primary conveyor assembly 184 may include a primary conveyor assembly frame 185. As illustrated in FIG. 29, a conveyor belt 186 may be provided in the primary conveyor frame 185. The primary conveyor belt 186 may have a primary conveyor belt loading end 187 and a primary conveyor belt discharge end 188. As illustrated in FIG. 30, a primary conveyor assembly motor 189 may drivingly engage the conveyor belt 186 typically at the primary conveyor belt discharge end 188 of the primary conveyor belt 186. The primary conveyor belt discharge end 188 of the primary conveyor belt 186 may be positioned above and in front of the milling drum housing 173 (FIG. 1)

which houses the milling drum 174 of the pavement milling machine 170. Accordingly, after the milling particles 182 are discharged from the conveyor assembly discharge portion 82 of the conveyor assembly frame 77 of the sweeper conveyor assembly 76 onto the primary conveyor belt 186 of the primary conveyor assembly 184, the primary conveyor belt 186 may carry the milling particles 182 forwardly and discharge the milling particles 182 onto the pre-milled road surface 190 ahead of the milling drum 174.

As further illustrated in FIG. 30, as it forms the mill cut 196 (FIG. 26) in the road surface 190, the rotating milling drum 174 may carry the dislodged milling particles 182 upwardly from the road surface 190. The intake conveyor 178 on the pavement milling machine 170 may receive and then deposit the milling particles 182 onto the discharge conveyor assembly 176. Accordingly, the discharge belt 177 of the discharge conveyor assembly 176 may transport the milling particles 182 forwardly, and ultimately, discharge the milling particles 182 into the dump truck 192 (FIG. 1). In the foregoing manner, the milling particles 182 may be discharged into successive dump trucks 192 which, after filled to capacity, may carry the milling particles 182 away and deposit them at a remote location. In some applications, the milling particles 182 may be used to formulate asphalt which may be used to subsequently pave the milled road surface 190 after the apparatus 1 removes or cleans the milling particles 182 from the mill cut 196.

Figure 5:
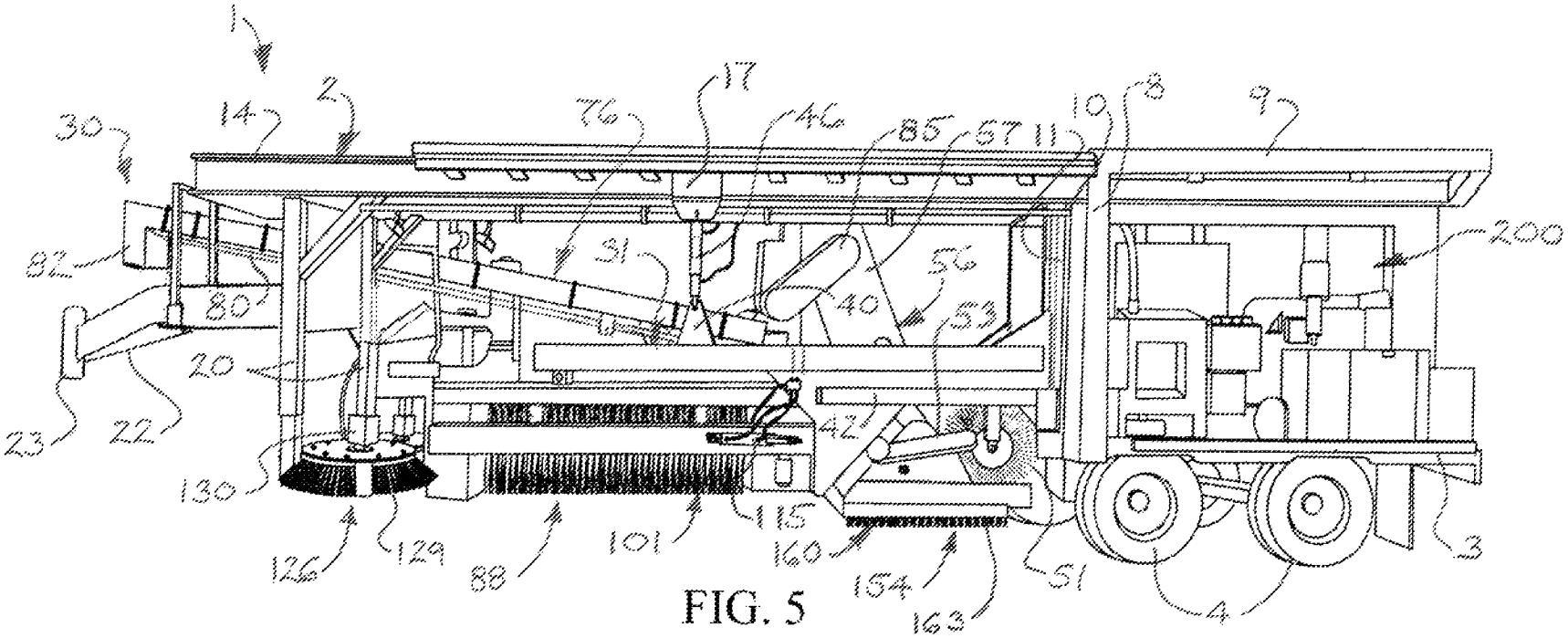
FIG. 5 is a typical left side perspective view of the illustrative pavement sweeping apparatus deployed in the transport configuration.
Figure 6:
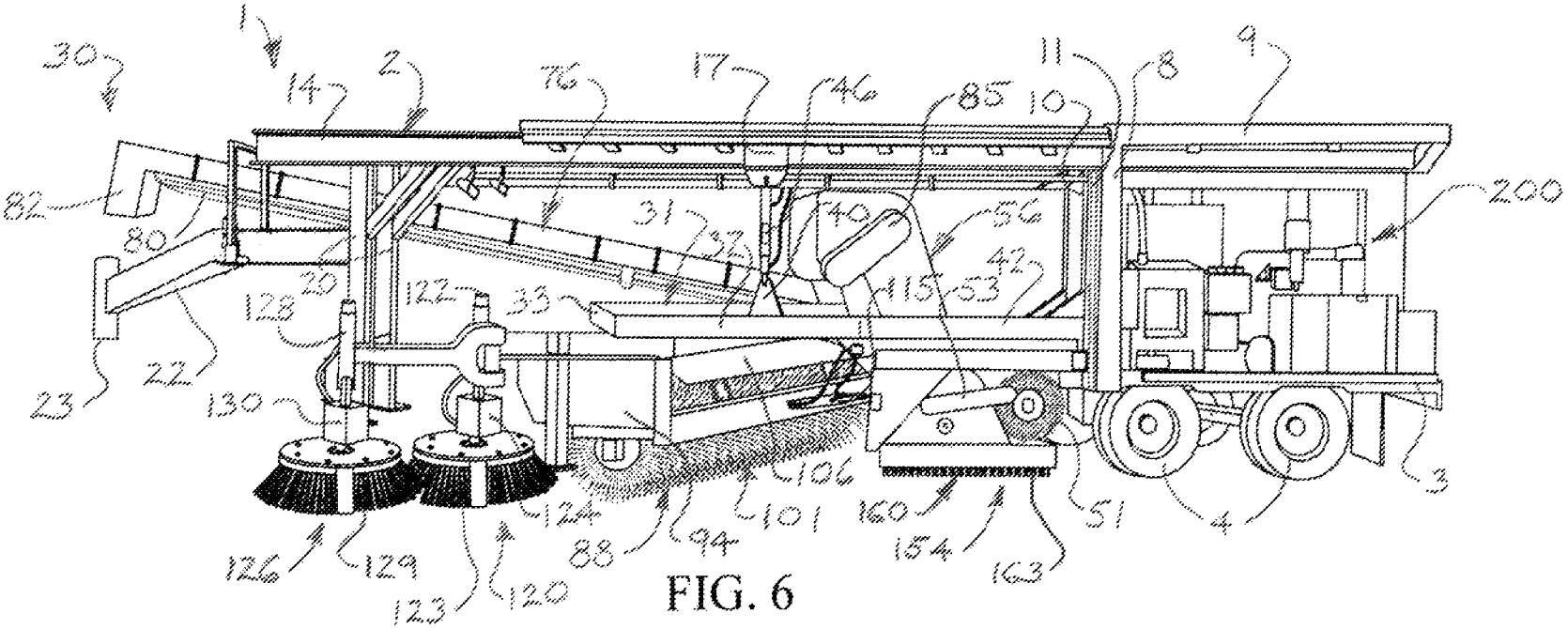
FIG. 6 is a typical left side perspective view of the illustrative pavement sweeping apparatus in the functional configuration.

Referring next to FIGS. 3-6 and 18-21 of the drawings, in some embodiments, at least one curb shoe broom assembly 154 may be provided on the sweeper assembly frame 31. A pair of curb shoe assemblies 154 may be provided on opposite sides of the sweeper assembly frame 31 typically adjacent to respective sides of the pickup unit 50. As illustrated in FIG. 18, each curb shoe broom assembly 154 may include an elongated assembly plate 155. On the right side of the sweeper assembly frame 31, the assembly plate 155 may be attached to the intake portion 57 of the pickup unit housing 56 typically using suitable fasteners (not illustrated). As illustrated in FIGS. 5 and 6, on the left side of the sweeper assembly frame 31, the assembly plate 155 may be attached to a gusset (not numbered) which may extend from a corresponding pickup unit support member 42, typically in like manner.

The assembly plate 155 may include an elongated, straight main plate segment 156. A deflecting plate segment 157 may extend from the main plate segment 156. The deflecting plate segment 157 may angle outwardly away from the pickup broom 51.

A curb shoe broom 160 may be mounted on the main plate segment 156 of the assembly plate 155. The curb shoe broom 160 may include an elongated curb shoe plate 161 which may be attached to the main plate segment 156 typically using suitable curb shoe mount fasteners and brackets 162, for example and without limitation. Curb shoe bristles 163 may extend from the curb shoe plate 161 along its length. The curb shoe plate 161 may be coextensive with the main plate segment 156 of the assembly plate 155 such that the deflecting plate segment 157 angles outwardly behind the rear end of the curb shoe plate 161.

In the functional configuration of the apparatus 1, as illustrated in FIGS. 22 and 26, the directing broom 101 may be disposed generally on a first side and forward of the pickup broom 51. The left side edge broom 123 may be disposed generally on the first side and forward of the directing broom 101. The left side curb broom 129 may be disposed generally on the first side and forward of the directing broom 101. The right side edge broom 137 may be disposed generally on a second side and forward of the pickup broom 51. The right side curb broom 145 may be disposed generally on the second side and forward of the pickup broom 51. As used herein, the term "generally on a first side and forward" or "generally on a second side and forward" refers to at least a portion of one broom being to the side of another broom with respect to the transverse axis 7 (FIG. 26) and in front of the other broom with respect to the direction of travel 6, respectively, and includes either overlapping or non-overlapping relationship of one broom with respect to another broom.

In typical application of the apparatus 1, which will be hereinafter further described, the pickup broom 51 may rotate in the clockwise direction illustrated in FIGS. 18-21. Accordingly, the pickup broom 51 may throw the milling particles 182 upwardly from the bottom mill cut surface 197 of the mill cut 196 and through the intake opening 59 in the intake portion 57 of the pickup unit housing 56, as was heretofore described with respect to FIG. 27. A portion of the stray milling particles 182 may fall against the main plate segment 156 and the deflecting plate segment 157 of the assembly plate 155 on each curb shoe broom 160, which may deflect the milling particles 182 back into the path of the pickup broom 51. The curb shoe bristles 163 of the curb shoe broom 160 may contact the mill cut surface 197 of the mill cut 196 and sweep the milling particles 182 into the path of the pickup broom 51, which may then pick up and eject the milling particles 182 through the intake opening 59 onto the pickup slats 73 on the pickup elevator assembly 66 in the intake portion interior 58 of the pickup unit housing 56, thus ensuring removal of residual milling particles 182 from the road surface 190.

Referring next to FIGS. 34-37 of the drawings, in some embodiments, each of the left side edge broom assembly 120, the left side curb broom assembly 126, the right side edge broom assembly 134 and the right side curb broom assembly 142 may include a gimbal joint assembly 224. The gimbal joint assembly 224 may facilitate universal angular positioning of the left side edge broom 123, left side curb broom 129, right side edge broom 137 and right side curb broom 145 with respect to the respective left side edge broom mount member 122 (FIG. 34), left side curb broom mount member 128, right side edge broom mount member 136 and right side curb broom mount member 144. Accordingly, the sweep angle or trajectory of the corresponding broom may be selectively varied according to the particular application by adjusting the angle or orientation of the broom with respect to the corresponding broom mount member. While it will be shown and described with respect to the right side edge broom assembly 134 in FIG. 34, the gimbal joint assembly 224 may be equally applicable to the left side edge broom assembly 120, the left side curb broom assembly 126 and the right side curb broom assembly 142.

Figure 36:
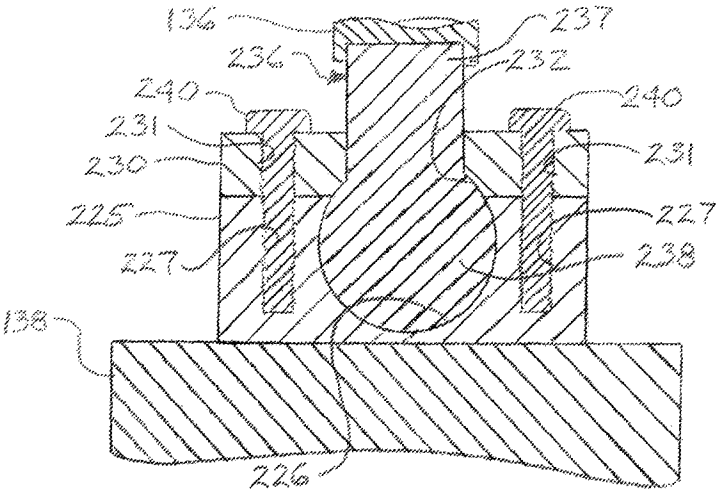
FIG. 36 is a sectional view of the gimbal joint assembly connecting the right side edge broom motor to the right side edge broom mount member of the right side edge broom assembly.
Figure 37:
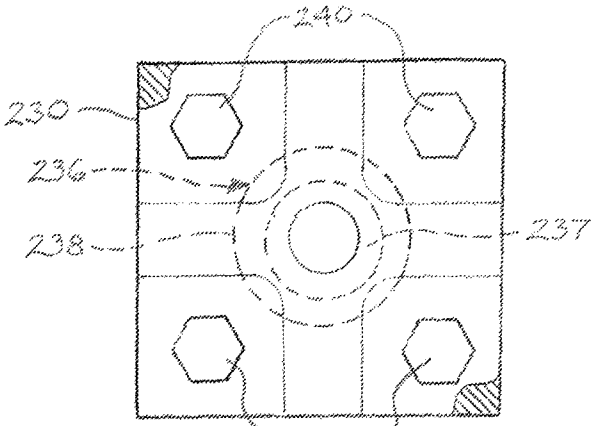
FIG. 37 is a top view of the gimbal joint assembly.
Figure 35:
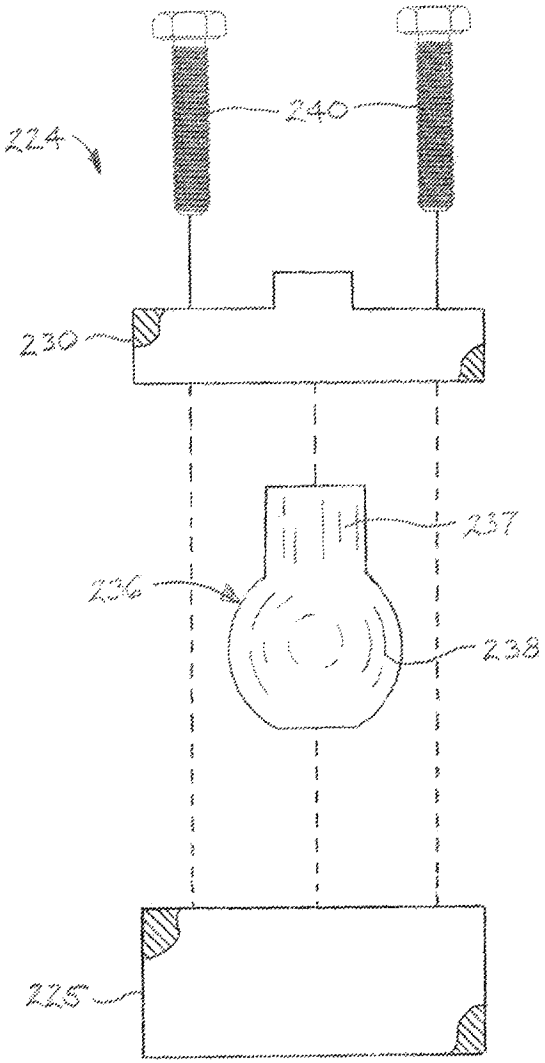
FIG. 35 is an exploded side view of a typical gimbal joint assembly suitable for the left side edge broom assembly, left side curb broom assembly, right side edge broom assembly and right side curb broom assembly.

As illustrated in FIGS. 35-37, in some embodiments, the gimbal joint assembly 224 may include an assembly base 225. As illustrated in FIG. 36, the assembly base 225 may be attached to the housing for the right side edge broom motor 138 via welding, mechanical fasteners and/or other suitable technique. A concave ball socket 226 may be provided in the assembly base 225. At least one interiorly-threaded fastener cavity 227 may extend into the assembly base 225.

An assembly cover 230 may be attached to the right side edge broom motor 138. In some embodiments, at least one joint fastener 240 may be extended through at least one fastener opening 231 in the assembly cover 230 and threaded into the corresponding underlying registering fastener cavity 227 to detachably secure the assembly cover 230 on the assembly base 225. A shaft opening 232 may extend through the assembly cover 230.

An assembly joint 236 may include an assembly joint shaft 237. An assembly joint ball 238 may terminate the assembly joint shaft 237. As illustrated in FIG. 36, the assembly joint ball 238 may fit in the ball socket 226 in the assembly base 225. The assembly joint shaft 237 may extend through the shaft opening 232 in the assembly cover 230. The right side edge broom mount member 136 of the right side edge broom assembly 134 may be secured to the assembly joint shaft 237 of the assembly joint 236 via welding, mechanical fasteners and/or other suitable technique known by those skilled in the art.

In typical application of the gimbal joint assembly 224, the joint fasteners 240 may initially be loosened to reduce the tension which the assembly cover 230 applies to the assembly joint ball 238, and hence, the tension which the assembly joint ball 238 applies against the ball socket 226 in the assembly base 225. This action may permit swivel movement of the assembly joint ball 238 in the ball socket 226 as the right side edge broom 137 pivots relative to the right side edge broom mount member 136. The right side edge broom 137 may next be pivoted to the desired sweep angle, after which the joint fasteners 240 may again be tightened to secure the assembly joint ball 238 of the assembly joint 236 against the ball socket 226 in the assembly base 225 and secure the right side edge broom 137 at the sweep angle. Subsequent adjustments to the sweep angle of the right side edge broom 137 may be made by loosening the joint fasteners 240, adjusting the right side edge broom 137 and again tightening the joint fasteners 240.

Figure 38:
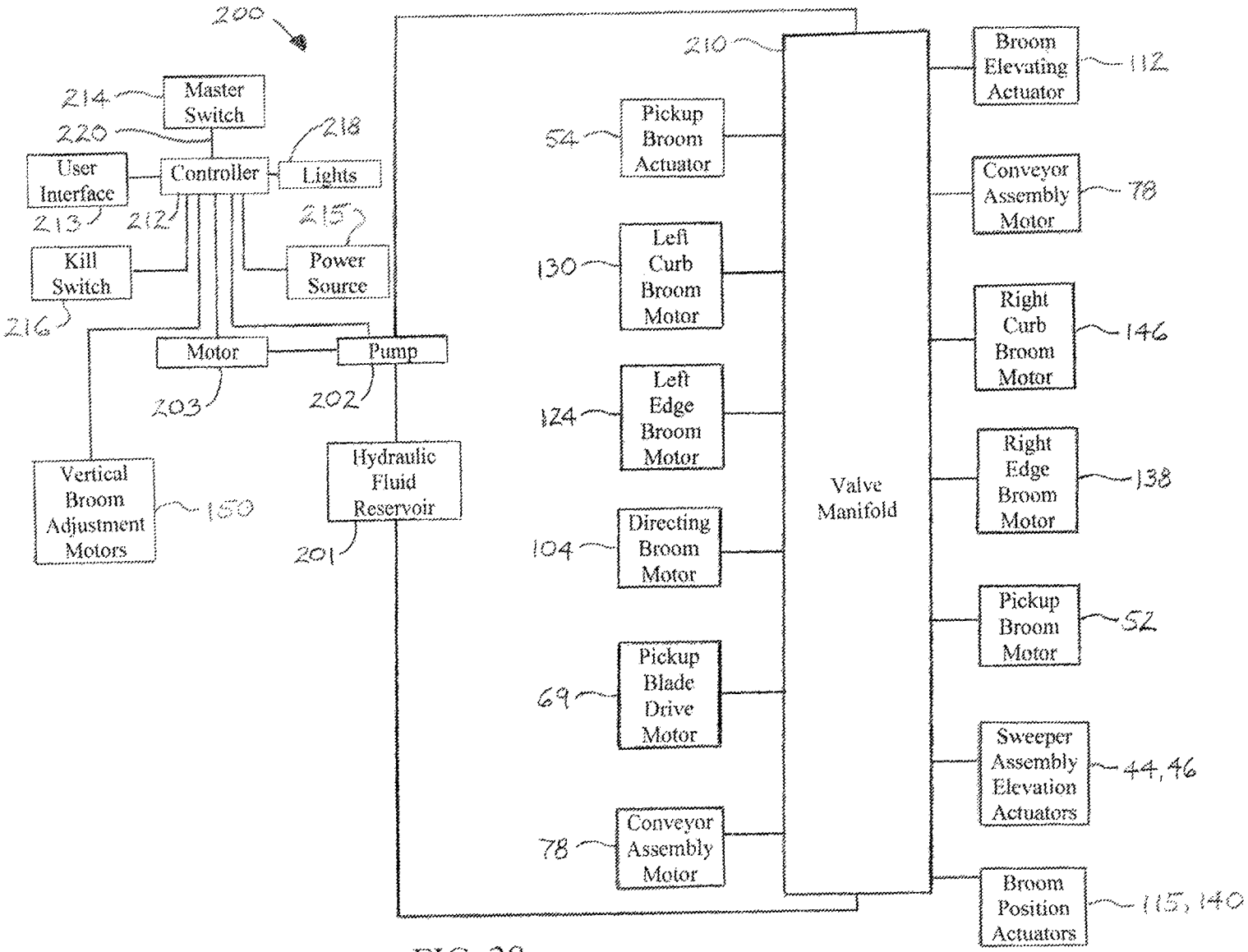
FIG. 38 is a functional block diagram of a typical control system suitable for the pavement sweeping apparatuses.

Referring next to FIG. 38 of the drawings, a typical apparatus control system 200 which is suitable for controlling the various hydraulic, pneumatic and/or electrical components of the apparatus 1 may include at least one valve manifold 210. The various hydraulic components of the apparatus 1 may be disposed in fluid communication with the valve manifold 210. In some embodiments, these hydraulic components may include but may not be limited to the directing broom actuator 112, the pickup broom actuator 54, the conveyor assembly motor 78, the left side curb broom motor 130, the right side curb broom motor 146, the left side edge broom motor 124, the right side edge broom motor 138, the directing broom motor 104, the pickup broom motor 52, the pickup elevator drive motor 69, the sweeper assembly elevation actuators 44, 46, the conveyor assembly motor 78 and the broom position actuators 115, 140. The valve manifold 210 may include at least one valve and actuation lever (not illustrated) for each hydraulic component. At least one hydraulic fluid reservoir 201 may be disposed in fluid communication with the valve manifold 210.

At least one hydraulic pump 202 may be disposed in fluid communication with the hydraulic fluid reservoir 201. At least one, and typically, a pair of drive motors 203 may drivingly engage the hydraulic pump 202. In some embodiments, the drive motors 203 may include internal combustion engines. Accordingly, in some embodiments, the valve and actuation levers of the valve manifold 210 may be manipulated to initiate operation and select the variable operational speeds or rpms of the left side edge broom motor 124 of the left side edge broom assembly 120, the left side curb broom motor 130 of the left side curb broom assembly 126, the right side edge broom motor 138 of the right side edge broom assembly 134, the right side curb broom motor 146 right side curb broom assembly 142, the conveyor assembly motor 78 of the sweeper conveyor assembly 76 and the primary conveyor assembly motor 189 of the primary conveyor assembly 184, for example and without limitation. In typical operation of the apparatus 1, rotational speeds for each of the pickup broom 51, the directing broom 101, the left side edge broom 123, the left side curb broom 129, the right side edge broom 137 and the right side curb broom 145 may not exceed about 200 rpm.

At least one controller 212 may controllably interface with the drive motors 203 and/or the hydraulic pump 202. As used herein, "controller" includes but is not limited to any type of device or combination of devices, whether on-board or remote, capable of executing all or individual functions of the apparatus 1 responsive to user input. In some embodiments, the controller 212 may include a single centralized controller or control system which may be provided on the chassis 3 or elsewhere on the apparatus frame 2, the sweeper assembly frame 31 or the pavement milling machine 170. In other embodiments, the controller 212 may include a plurality of controllers or control systems placed at different positions on the apparatus frame 2, the sweeper assembly frame 31 and/or the pavement milling machine 170. In some embodiments, the controller 212 may include a separate controller for each electrical and/or hydraulic component of the apparatus 1. The controller 212 may have at least one user interface 213 which may facilitate user operation and control of the various electrical components.

At least one power source 215 may electrically interface with the controller 212. In some embodiments, the power source 215 may include at least one battery, at least one solar panel and/or at least one electrical generator. Various electrical components such as the vertical broom adjustment motors 150 on the respective left side edge broom assembly 120, left side curb broom assembly 126, right side edge broom assembly 134 and right side curb broom assembly 142, for example and without limitation, may functionally interface with the controller 212. In some embodiments, the controller 212 may have the capability to program the various electrical and/or hydraulic components according to selected operational parameters, such as the operational speeds of the left side edge broom motor 124 of the left side edge broom assembly 120, the left side curb broom motor 130 of the left side curb broom assembly 126, the right side edge broom motor 138 of the right side edge broom assembly 134 and the right side curb broom motor 146 right side curb broom assembly 142, for example and without limitation, according to the knowledge of those skilled in the art.

At least one master switch 214 may functionally interface with the controller 212. In some embodiments, the master switch or switches 214 may be provided in one or more selected accessible locations or positions on the pavement milling machine 170. Accordingly, the master switch 214 may be detachably connected to the controller 212 through a suitable electrical cable 220. Manipulation of the master switch 214 may be required to initiate control of the various electrical and/or hydraulic components of the apparatus 1 typically via the controller 212 and/or the valve manifold 210.

In some embodiments, at least one kill switch 216 may functionally interface with the controller 212. The kill switch 216 may facilitate immediate shutdown of the electrical and/or hydraulic components of the apparatus 1 upon actuation for safety purposes. The kill switch 216 may be placed in any location or position on the apparatus 1 which is accessible to an operator.

In some embodiments, at least one light 218 may functionally interface with the controller 212. The lights 218 may be placed at selected locations or positions on the apparatus frame 2, the sweeper assembly frame 31 and/or the pavement milling machine 170 to illuminate the area of the road surface 190 which is being milled and cleaned.

Referring next to FIGS. 1, 2 and 22-30 of the drawings, in typical application, the apparatus 1 may initially be towed to a road surface 190 which is to be repaved. Accordingly, the hitch coupling 23 on the hitch frame 22 of the apparatus 1 may be coupled to a hitch receiver on a towing vehicle (not illustrated), which may be used to tow the apparatus 1 to the road surface 190. Preparatory to transport, the directing broom assembly 88, left side edge broom assembly 120, left side curb broom assembly 126, right side edge broom assembly 134 and right side curb broom assembly 142 may be deployed in the folded, transport or storage configuration illustrated in FIG. 22.

The pavement milling machine 170 may be positioned on the road surface 190 at the location at which the mill cut 196 is to begin being formed in the road surface 190. Upon its arrival, the apparatus 1 may be positioned on the road surface 190 behind the pavement milling machine 170, uncoupled from the towing vehicle and then typically coupled to the hitch receptacle 181 on the hitch receptacle support 180 on the rear end of the pavement milling machine 170, as illustrated in FIGS. 29 and 30. As illustrated in FIG. 29, the conveyor assembly discharge portion 82 of the sweeper conveyor assembly 76 on the apparatus 1 may register with or be placed in alignment with the primary conveyor belt loading end 187 of the primary conveyor belt 186 on the pavement milling machine 170.

The directing broom assembly 88, left side edge broom assembly 120, left side curb broom assembly 126, right side edge broom assembly 134 and right side curb broom assembly 142 may be deployed from the folded, transport or storage configuration of FIG. 22 to the extended, functional configuration of FIG. 23. In some applications, the each of the left side edge broom 123, the left side curb broom 129, the right side edge broom 137 and the right side curb broom 145 may be selectively adjustable to a desired sweep angle with respect to the corresponding left side edge broom mount member 122, left side curb broom mount member 128, right side edge broom mount member 136 and right side curb broom mount member 144 typically by adjustment of the gimbal joint assembly 224 as was heretofore described with respect to FIGS. 34-37. As illustrated in FIG. 1, an empty dump truck 192 may be positioned on the roadway surface 190 beneath the discharge end of the discharge conveyor assembly 176.

The pavement milling machine 170 may next be operated to initiate formation of the mill cut 196 in the road surface 190. Accordingly, as the pavement milling machine 170 is driven forwardly on the road surface 190, the milling drum 174 may be rotated in the counterclockwise direction in FIG. 30 such that it cuts the mill cut 196, dislodging milling particles 182 of various sizes from the road surface 190. As illustrated in FIGS. 25 and 26, the mill cut 196 may have the planar bottom mill cut surface 197 with the opposite, typically vertical edge surfaces 198 extending from the sides of the mill cut surface 197 and the curb surfaces 199 extending outwardly from the respective vertical edge surfaces 198. In some applications, the mill cut 196 may have a width of about 10-14 feet between the edge surfaces 198 and the bottom mill cut surface 197 may have a depth of up to typically about 10 inches.

As illustrated in FIG. 30, as it forms the mill cut 196, the milling drum 174 may throw most of the milling particles 182 upwardly onto the intake conveyor 178. The pavement milling machine 170 may transport the milling particles 182 forward, typically via an internal transport mechanism (not illustrated), and discharge the milling particles 182 onto the discharge belt 177 of the discharge conveyor assembly 176. The discharge belt 177 may transport the milling particles 182 forwardly and upwardly and discharge the milling particles 182 into the dump truck 192. After it has been filled to capacity, the dump truck 192 may transport the milling particles 182 to a suitable destination (not illustrated), where the milling particles 182 may be unloaded from the dump truck 192, and a replacement empty dump truck 192 positioned under the discharge conveyor assembly 176 for continued operation. In some applications, the milling particles 182 may be used to formulate or reconstitute asphalt which may be subsequently used to pave the milled road surface 190, as is known by those skilled in the art.

As the milling drum 174 forms the mill cut 196 in the road surface 190, a substantial quantity of the milling particles 182 may fall onto the bottom mill cut surface 197 and the curb surfaces 199 and may cling to the edge surfaces 198 of the mill cut 196. These milling particles 182 must be substantially removed or cleaned from these surfaces to facilitate optimal adhesion or adherence of the asphalt pavement which will subsequently be deposited into the mill cut 196 and onto the curb surfaces 199 during the ensuing paving operation. Accordingly, the apparatus 1 may substantially remove or clean the milling particles 182 from the milled road surface 196 in a single pass as the pavement milling machine 170 typically tows the apparatus 1 at the same speed or rate as the milling operation.

As illustrated in FIGS. 24-26, the pickup broom 51 may be adjusted to rest on the bottom mill cut surface 197 of the mill cut 196 typically by actuation of the pickup broom actuator 54 (FIG. 18). The directing broom assembly 88 may be operated to rest the directing broom 101 on the bottom mill cut surface 197 of the mill cut 196 typically by operation of the directing broom actuator 112 (FIG. 8). The left side edge broom assembly 120 may be adjusted to rest the left side edge broom 123 on the bottom mill cut surface 197 and against the corresponding left side edge surface 198 of the mill cut 196 typically by actuation of its vertical broom adjustment motor 150 (FIG. 7). Similarly, the left side curb broom assembly 126 may be adjusted to rest the left side curb broom 129 on the corresponding left side curb surface 199 of the road surface 190. The right side edge broom assembly 134 may be adjusted to rest the right side edge broom 137 on the bottom mill cut surface 197 and against the corresponding right side edge surface 198 of the mill cut 196. The right side curb broom assembly 142 may be adjusted to rest the right side curb broom 145 on the corresponding right side curb surface 199 of the road surface 190. Course adjustments in the vertical position of the sweeper assembly 30 on the apparatus frame 2 and with respect to the road surface 190 may be facilitated by actuation of the rear sweeper assembly elevation actuators 44 and side sweeper assembly elevation actuators 46.

As illustrated in FIG. 26, as the apparatus 1 traverses the milled road surface 190, the left side edge broom 123 and the left side curb broom 129 may be rotated in the clockwise direction, whereas the right side edge broom 137 and the right side curb broom 145 may be rotated in the counterclockwise direction. The pickup broom 51 may be rotated in the counterclockwise direction as viewed from the right side end, as illustrated in FIG. 27. The directing broom 101 may be rotated in the clockwise direction as viewed from the left side end, as illustrated in FIGS. 5 and 6. In typical application, the pickup broom 51, the directing broom 101, the left side edge broom 123, the left side curb broom 129, the right side edge broom 137 and the right side curb broom 145 may rotate at a speed of up to about 200 rpm, depending typically on the travel speed of the pavement milling machine 170, which in some applications may range from about 1 foot/min to about 90 feet/min.

The rotating left side edge broom 123 may dislodge and sweep milling particles 182 from the left side edge surface 198 and from the portion of the bottom mill cut surface 197 which lies in the left side edge broom sweep path 125 of the left side edge broom 123 into the directing broom sweep path 105 of the directing broom 101. The rotating left side curb broom 129 may dislodge and sweep milling particles 182 from the left side curb surface 199 into the left side edge broom sweep path 125 of the left side edge broom 123 and/or the directing broom 101. The angled directing broom 101 may sweep the milling particles 182 in its directing broom sweep path 105 into the pickup unit sweep path 61 of the pickup broom 51.

The rotating right side edge broom 137 may dislodge and sweep milling particles 182 from the right side edge surface 198 and from the portion of the bottom mill cut surface 197 which lies in its right side edge broom sweep path 141 into the pickup unit sweep path 61 of the pickup broom 51. The rotating right side curb broom 145 may dislodge and sweep milling particles 182 from the right side curb surface 199 into the path of the right side edge broom 137 and/or the pickup broom 51. Thus, substantially all the milling particles 182 dislodged and swept by the left side edge broom 123, the left side curb broom 129, the directing broom 101, the right side edge broom 137 and the right side curb broom 145 may accumulate in the pickup unit sweep path 61 of the pickup broom 51.

As illustrated in FIG. 27, the pickup elevator drive motor 69 (FIG. 28) may be operated to drive the pickup elevator assembly 66 of the pickup unit 50 in the counterclockwise direction illustrated in FIG. 27. As it contacts the milling particles 182 in its path, the pickup broom 51 may throw the milling particles 182 from the bottom mill cut surface 197 of the mill cut 196 upwardly and forwardly through the intake opening 59 and onto the rising pickup slats 73 of the pickup elevator assembly 66, squeegeed against the front housing wall 75 of the pickup using housing 56. As the pickup chains 72 traverse the respective drive shaft sprockets 68, the rising pickup slats 73 may carry or lift the milling particles 182 against the front housing wall 75 and then discharge the milling particles 182 through the communication interface 74 into the transfer portion interior 63 of the transfer portion 62. As illustrated in FIG. 28, the rotating transfer auger 64 may transfer the milling particles 182 toward and then through the discharge opening 65, after which the milling particles 182 may fall onto the sweeper conveyor assembly conveyor belt 80 of the sweeper conveyor assembly 76.

As illustrated in FIGS. 27-29, responsive to operation of the conveyor assembly motor 78, the conveyor assembly drive roller 79 (FIG. 29) may drive the upper run of the sweeper conveyor assembly conveyor belt 80 of the sweeper conveyor assembly 76 forwardly toward the pavement milling machine 170, in the direction indicated by the arrow in FIGS. 27-29. As illustrated in FIG. 29, the sweeper conveyor assembly conveyor belt 80 may subsequently discharge the milling particles 182 from the conveyor assembly discharge portion 82 of the conveyor assembly frame 77 of the sweeper conveyor assembly 76 onto the conveyor belt 186 of the primary conveyor assembly 184. The conveyor belt 186 may subsequently carry the milling particles 182 forwardly and then discharge the milling particles 182 onto the road surface 190 ahead of the milling drum 174, as illustrated in FIG. 30. The rotating milling drum 174 may throw the discharged milling particles 182 along with the freshly-dislodged milling particles 182 upwardly from the road surface 190 onto the intake conveyor 178, after which the milling particles 182 may be deposited onto the discharge conveyor assembly 176 and then discharged into the dump truck 192. In the foregoing manner, the apparatus 1 may remove the milling particles 182 from the milled road surface 196 as the pavement milling machine 170 tows the apparatus 1 typically at the same travel speed as that of the pavement milling machine 170. Thus, the sweep rate or removal rate of the apparatus 1 may correspond to or equal the milling speed or rate of the pavement milling machine 170. Accordingly, it will be appreciated by those skilled in the art that the apparatus 1 may substantially clean or remove the milling particles 182 from the milled road surface 190 within from about 5 seconds to about 60 seconds of the moment at which the pavement milling machine 170 forms the mill cut 196 in the road surface 190, depending typically on the travel speed of the pavement milling machine 170. Accordingly, the apparatus 1 may substantially clean or remove the milling particles 182 from the milled road surface 190 in a single pass at the same forward speed of the pavement milling machine 170. The paving operation may ftllow the cleaning operation by deposition of asphalt into the cleaned mill cut 196 and onto the cleaned curb surfaces 199 of the road surface 190.

After use, the apparatus 1 may be uncoupled from the pavement milling machine 170. The sweeper assembly 30 may be raised on the apparatus frame 2 to lift the brooms from the mill cut 196 and the road surface 190. The brooms may be individually raised by actuation of the respective actuators and motors. The brooms may be returned to the transport configuration (FIG. 22) and then towed away from the road surface 190.

It will be appreciated by those skilled in the art that the pavement sweeping apparatus 1 is capable of removing the milling particles 182 from the milled road surface 190 at a removal rate which equals or corresponds to the milling speed or rate of the pavement milling machine 170. Accordingly, in some applications, the apparatus 1 may substantially remove the milling particles 182 from the milled road surface 190 within from about 5 seconds to about 60 seconds of formation of the mill cut 196 in the road surface 190. This time range may be achieved by attaining a travel speed of up to about 90 feet/min for the pavement milling machine 170 and the apparatus 1 and rotational speeds of up to about 200 rpm for each of the pickup broom 51, the directing broom 101, the left edge broom 123, the left curb broom 129, the right edge broom 137 and the right curb broom 145. In some applications, the apparatus 1 may remove up to about 98% of the milling particles 182 from the milled road surface 190 in a single pass and at the same rate as the milling rate or travel speed of the pavement milling machine 170. This expedient may facilitate immediate paving of the cleaned milled road surface 190 and expeditious completion of the road paving operation. In some embodiments, typical distance between the milling drum 174 of the pavement milling machine 170 and the chassis wall 8 of the chassis 3 may be about 22-25 feet. Typical distance between the center of the milling drum 174 and the hitch receptacle 181 of the pavement milling machine 170 may be about 17 feet 4 inches, whereas a typical distance between the hitch receptacle 181 and the chassis wall 8 of the chasses 3 may be about 25 feet, although these dimensions may vary among embodiments.

Figure 39:
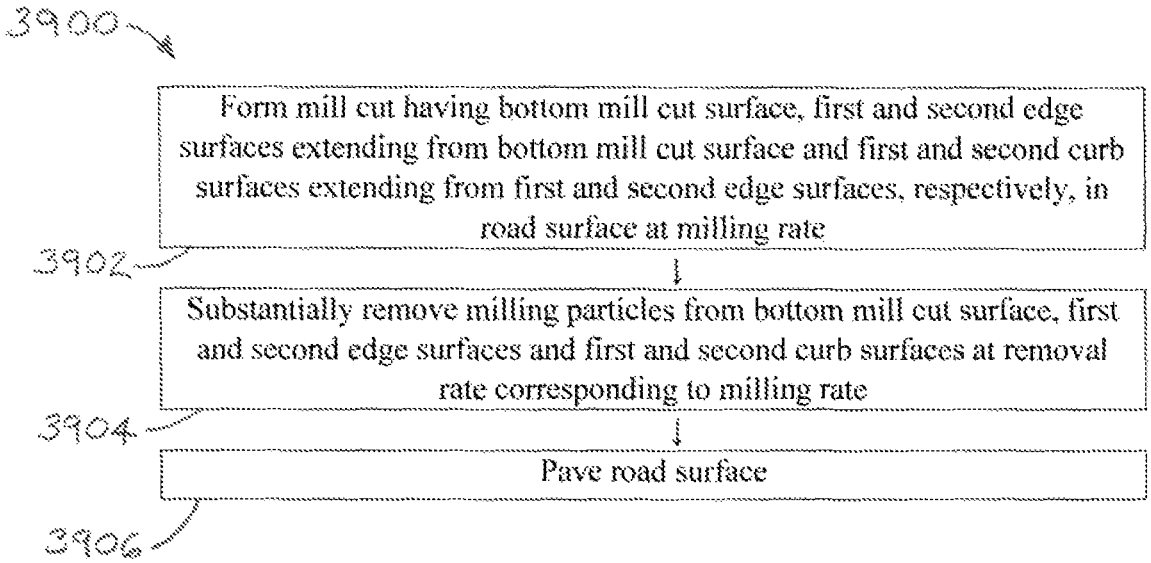
FIG. 39 is a flow diagram which illustrates a typical overall process flow according to an illustrative embodiment of the pavement sweeping methods.

Referring next to FIG. 39 of the drawings, a flow diagram which illustrates a typical overall process flow according to an illustrative embodiment of the pavement sweeping methods is generally indicated by reference numeral 3900. At Step 3902, a mill cut may be formed in the road surface at a selected milling rate. The mill cut may have a bottom mill cut surface, first and second edge surfaces extending from the bottom mill cut surface and first and second curb surfaces extending from the first and second edge surfaces, respectively.

At Step 3904, the milling particles may be substantially cleaned or removed from the bottom mill cut surface, the first and second edge surfaces and the first and second curb surfaces at a removal rate which corresponds to the milling rate.

At Step 3906, the milled and cleaned road surface may be paved.

Figure 40:
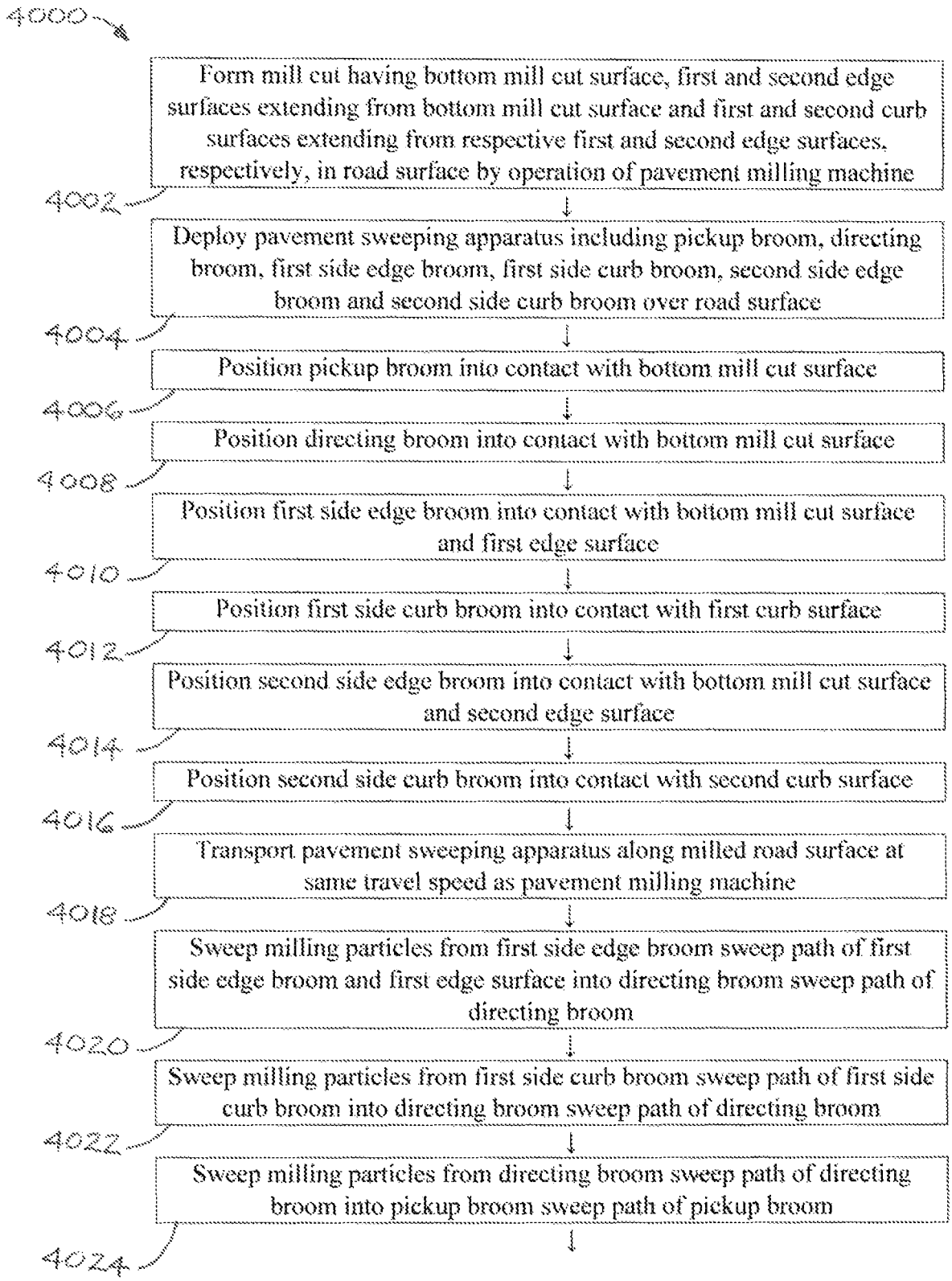
FIG. 40 is a flow diagram which illustrates an illustrative embodiment of the pavement sweeping methods.
Figure 40:
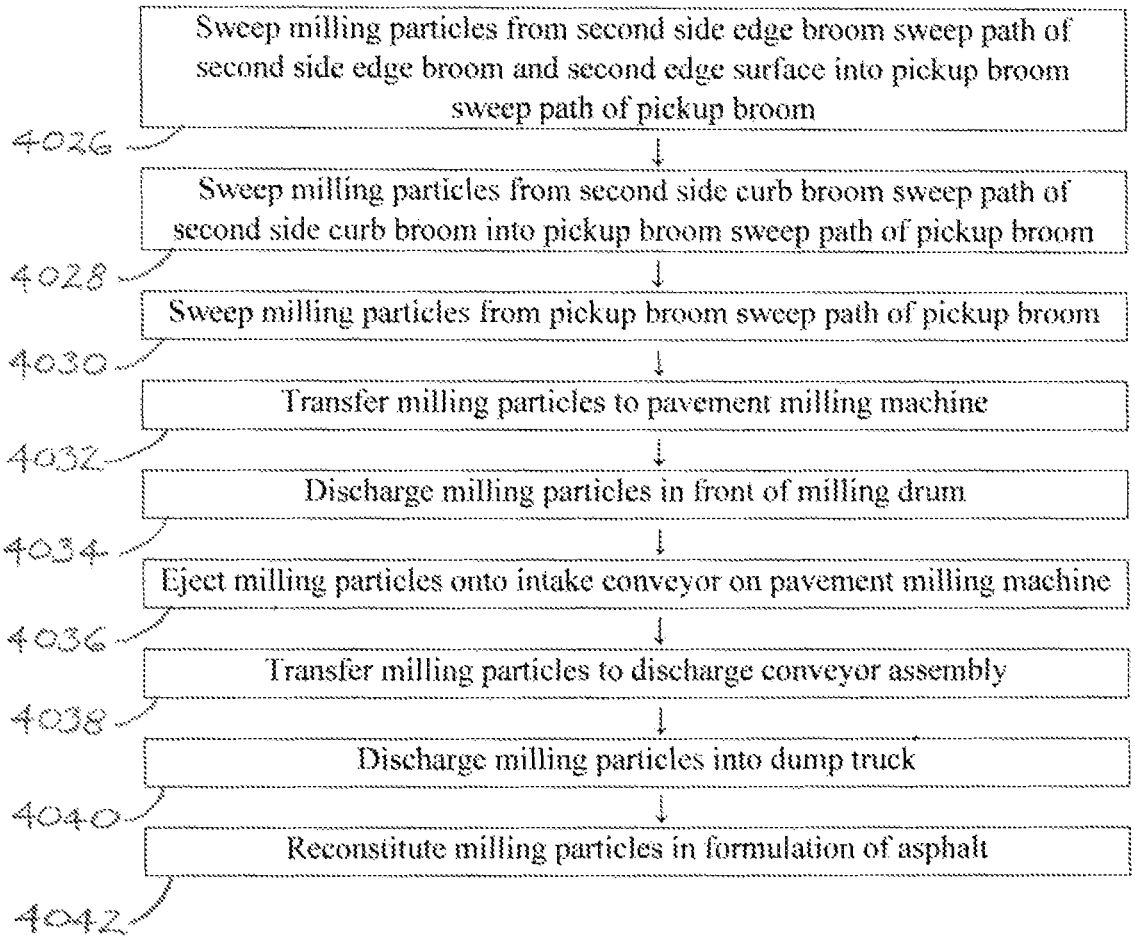

Referring next to FIG. 40 of the drawings, a flow diagram which illustrates an illustrative embodiment of the pavement sweeping methods is generally indicated by reference numeral 4000. Steps 4002-4042 of the flow diagram 4000 may correspond to Steps 3902 and 3904 in the flow diagram 3900 in FIG. 39, described above. At Step 4002, a mill cut may be formed in the road surface by operation of a pavement milling machine. The mill cut may have a bottom mill cut surface, first and second edge surfaces extending from the bottom mill cut surface and first and second curb surfaces extending from the first and second edge surfaces, respectively.

At Step 4004, a pavement sweeping apparatus may be deployed over the road surface. The pavement sweeping apparatus may include at least one pickup broom, at least one directing broom, at least one first side edge broom, at least one first side curb broom, at least one second side edge broom and at least one second side curb broom.

At Step 4006, the pickup broom may be positioned into contact with the bottom mill cut surface of the mill cut.

At Step 4008, the directing broom may be positioned into contact with the bottom mill cut surface.

At Step 4010, the first side edge broom may be positioned into contact with the bottom mill cut surface and the first edge surface.

At Step 4012, the first side curb broom may be positioned into contact with the first curb surface.

In Step 4014, the second side edge broom may be positioned into contact with the bottom mill cut surface and the second edge surface.

In Step 4016, the second side curb broom may be positioned into contact with the second curb surface. Steps 4006-4016 may be carried out in any order or simultaneously.

In Step 4018, the pavement sweeping apparatus may be transported along the milled road surface at the same travel speed as the pavement milling machine. In some applications, the pavement sweeping apparatus may be coupled to the pavement milling machine, which may tow the apparatus over the road surface.

In Step 4020, milling particles may be swept from a first side edge broom sweep path of the first side edge broom and the first edge surface into a directing broom sweep path of the directing broom.

In Step 4022, milling particles may be swept from the first side curb broom sweep path of the first side curb broom into the directing broom sweep path of the directing broom.

In Step 4024, milling particles may be swept from the directing broom sweep path of the directing broom into a pickup unit sweep path of the pickup broom.

In Step 4026, milling particles may be swept from a second side edge broom sweep path of the second side edge broom and the second edge surface into the pickup unit sweep path of the pickup broom.

In Step 4028, milling particles may be swept from the second side curb broom sweep path of the second side curb broom into the pickup unit sweep path of the pickup broom.

In Step 4030, milling particles may be swept from the pickup unit sweep path of the pickup broom. Steps 4020-4030 may be carried out simultaneously as the pavement sweeping apparatus is transported over the road surface.

In Step 4032, the removed milling particles may be transferred to the pavement milling machine. In some applications, the milling particles may be transferred from the pickup unit onto a sweeper conveyor assembly on the pavement sweeping apparatus and from the sweeper conveyor assembly onto a primary conveyor assembly on the pavement milling machine.

In Step 4034, the removed milling particles may be discharged in front of a milling drum on the pavement milling machine. In some applications, the milling particles may be discharged from the primary conveyor assembly in front of the milling drum.

In Step 4036, the removed milling particles may be ejected onto an intake conveyor on the pavement milling machine.

In Step 4038, the removed milling particles may be transferred from the intake conveyor to a discharge conveyor assembly on the pavement milling machine.

In Step 4040, the removed milling particles may be discharged from the discharge conveyor assembly into a dump truck and transported to a suitable destination. Steps 4032-4040 may be carried out simultaneously with Steps 4018-4030.

In Step 4042, the removed milling particles may be reconstituted and reformulated into asphalt.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A pavement sweeping apparatus for traversing pavement and substantially removing particulate milling particles from the pavement, comprising:

a directionally mobile apparatus frame having a longitudinal midline axis;

at least one pickup unit carried by the apparatus frame, the at least one pickup unit having a first side and a second side and configured to form a pickup unit sweep path on the pavement;

at least one actuatable first side edge broom carried by the apparatus frame on the first side and forward of the at least one pickup unit;

at least one actuatable first side curb broom carried by the apparatus frame on the first side and forward of the at least one pickup unit;

at least one actuatable second side edge broom carried by the apparatus frame on the second side and forward of the at least one pickup unit;

at least one actuatable second side curb broom carried by the apparatus frame on the second side and forward of the at least one pickup unit;

at least one actuatable directing broom carried by the apparatus flame on the first side and forward of the at least, one pickup unit and configured to contact the pavement, the at least one actuatable first side edge broom and the at least one actuatable first side curb broom are disposed on a first side and forward of the at least one actuatable directing broom; and the at least one actuatable directing broom having a longitudinal broom axis disposed at an acute directing broom angle to the longitudinal midline axis of the apparatus frame and configured to form a directing broom sweep path on the pavement, whereby the at least one actuatable directing broom is configured to sweep at least a portion of the particulate milling particles from the directing broom sweep path into the pickup unit sweep path of the at least one pickup unit.

2. The pavement sweeping apparatus of claim 1 wherein the acute directing broom angle is from 25 degrees to 30 degrees.

3. The pavement sweeping apparatus of claim 1 wherein the at least one pickup unit comprises at least one pickup broom.

4. The pavement sweeping apparatus of claim 1 wherein each of the at least one actuatable first side curb broom and the at least one actuatable second side curb broom is vertically adjustable.

5. The pavement sweeping apparatus of claim 1 further comprising at least one hitch frame carried by the apparatus frame and at least one hitch coupling carried by the at least one hitch frame.

6. The pavement sweeping apparatus of claim 1 further comprising a sweeper assembly including a sweeper assembly frame carried by and vertically adjustable with respect to the apparatus fame, and wherein the at least one pickup unit, the at least one actuatable directing broom, the at least one actuatable first side edge broom, the at least one actuatable first side curb broom, the at least one actuatable second side edge broom and the at least one actuatable second side curb broom are carried by the sweeper assembly frame.

7. The pavement sweeping apparatus of claim 6 further comprising at least one curb shoe broom assembly having at least one curb shoe broom carried by the sweeper frame on at least one side of the at least one pickup unit.

8. The pavement sweeping apparatus of claim 7 wherein the at least one curb shoe broom assembly comprises a pair of curb shoe broom assemblies carried by the sweeper frame on the first side and the second side, respectively, of the at least one pickup unit.

9. The pavement sweeping apparatus of claim 1 wherein the pickup unit comprises at least one actuatable pickup broom, a pickup unit housing forward of the at least one actuatable pickup broom, a pickup elevator assembly in the pickup unit housing and at least one discharge opening in the pickup unit housing.

10. The pavement sweeping apparatus of claim 9 further comprising at least one sweeper conveyor assembly including a sweeper conveyor assembly conveyor belt having a sweeper conveyor assembly conveyor belt loading end disposed beneath the at least one discharge opening and a sweeper conveyor assembly conveyor belt discharge end opposite the sweeper conveyor assembly conveyor belt loading end.

11. A pavement sweeping apparatus, comprising:

a directionally mobile apparatus frame;

at least one pickup unit carried by the apparatus frame, the at least one pickup unit having a first side and a second side;

at least one actuatable first side edge broom carried by the apparatus frame on the first side and forward of the at least one pickup unit;

at least one actuatable first side curb broom carried by the apparatus frame on the first side and forward of the at least one pickup unit;

at least one actuatable second side edge broom carried by the apparatus frame on the second side and forward of the at least one pickup unit;

at least one actuatable second side curb broom carried by the apparatus frame on the second side and forward of the at least one pickup unit;

at least one actuatable directing broom carried by the apparatus frame on the first side and forward of the at least one pickup unit, the at least one actuatable first side edge broom and the at least one actuatable first side curb broom are disposed on the first side and forward of the at least one actuatable directing broom;

a sweeper assembly including a sweeper assembly frame carried by and vertically adjustable with resect to the apparatus frame;

wherein the at least one pickup unit, the at least one actuatable directing broom, the at least one actuatable first side edge broom, the at least one actuatable first side curb broom, the at least one actuatable second side edge broom and the at least one actuatable second side curb broom are carried by the sweeper assembly frame of the sweeper assembly; and wherein each of the at least one pickup unit, the at least one actuatable directing broom, the at least one actuatable first side edge broom, the at least one actuatable first side curb broom, the at least one actuatable second side edge broom and the at least one actuatable second side curb broom is independently vertically adjustable with respect to the sweeper assembly frame.

12. A pavement sweeping, apparatus, comprising:

a directionally mobile apparatus frame;

at least one pickup unit carried by the apparatus frame, the at least one pickup unit having a first side and a second side;

at least one actuatable first side edge broom carried by the apparatus frame on the first side and forward of the at least one pickup unit;

at least one actuatable first side curb broom carried by the apparatus frame on the first side and forward of the at least one pickup unit;

at least one actuatable second side edge broom carried by the apparatus frame on the second side and forward of the at least one pickup unit;

at least one actuatable second side curb broom carried by the apparatus frame on the second side and forward of the at least one pickup unit;

wherein the pickup unit includes at least one actuatable pickup broom, a pickup unit housing forward of the at least one actuatable pickup broom, a pickup elevator assembly in the pickup unit housing and at least one discharge opening in the pickup unit housing;

at least one sweeper conveyor assembly including a sweeper conveyor assembly conveyor belt having a sweeper conveyor assembly conveyor belt loading end disposed beneath the at least one discharge opening and a sweeper conveyor assembly conveyor belt discharge end opposite the sweeper conveyor assembly conveyor belt loading end; and wherein the directionally mobile apparatus frame is configured for coupling to a pavement milling machine having at least one milling drum, and further comprising at least one primary conveyor configured for mounting on the pavement milling machine, the at least one primary conveyor having a primary conveyor belt with a primary conveyor belt loading end disposed beneath the sweeper conveyor assembly conveyor belt discharge end of the sweeper conveyor assembly conveyor belt and a primary conveyor belt discharge end disposed above and in front of the at least one milling drum.

13. The pavement sweeping apparatus of claim 12 further comprising at least one actuatable directing broom carried by the apparatus frame on the first side and forward of the at least one pickup unit, and wherein the at least one actuatable first side edge broom and the at least one actuatable first side curb broom are disposed on the first side and forward of the at least one actuatable directing broom, and wherein the at least one actuatable directing broom is selectively positional at an angle relative to a direction of travel of the directionally mobile apparatus frame.

14. The pavement sweeping apparatus of claim 13 wherein the at least one actuatable directing broom, the at least one actuatable first side edge broom, the at least one actuatable first side curb broom, the at least one actuatable second side edge broom and the at least one actuatable second side curb broom are selectively deployable in a folded, storage or transport configuration and an extended, functional configuration.

15. A pavement sweeping apparatus, comprising:

a directionally mobile apparatus frame;

a sweeper assembly including:

a sweeper assembly frame carried by and vertically adjustable with respect to the directionally mobile apparatus frame;

a pickup unit carried by the sweeper assembly frame, the pickup unit having at least one actuatable pickup broom;

at least one directing broom assembly including:

a directing broom assembly frame pivotally carried by the sweeper assembly frame;

a broom mount frame carried by the directing broom assembly frame; and at least one actuatable directing broom carried by the broom mount frame on a first side and forward of the at least one actuatable pickup broom, the at least one directing broom assembly is selectively positional at an angle relative to a direction of travel of the directionally mobile apparatus frame;

at least one first side edge broom assembly including:

a first side edge broom assembly arm carried by the directing broom assembly frame of the at least one directing broom assembly;

a first side edge broom mount member carried by the first side edge broom assembly arm; and at least one actuatable first side edge broom carried by the first side edge broom mount member on the first side and forward of the at least one actuatable directing broom;

at least one first side curb broom assembly including:

a first side curb broom assembly arm pivotally carried by the directing broom assembly frame of the at least one directing broom assembly;

a first side curb broom mount member carried by the first side curb broom assembly arm; and at least one actuatable first side curb broom carried by the first side curb broom mount member on the first side and forward of the at least one directing broom;

at least one second side edge broom assembly including:

a second side edge broom assembly arm pivotally carried by the sweeper assembly frame;

a second side edge broom mount member carried by the second side edge broom assembly arm; and at least one actuatable second side edge broom carried by the second side edge broom mount member on a second side and forward of the at least one actuatable pickup broom; and at least one second side curb broom assembly including:

a second side curb broom assembly arm pivotally carried by the sweeper assembly frame;

a second side curb broom mount member carried by the second side curb broom assembly arm; and at least one actuatable second side curb broom carried by the second side curb broom mount member on the second side and forward of the at least one actuatable pickup broom; and the at least one directing broom assembly, the at least one first side edge broom assembly, the at least one first side curb broom assembly, the at least one second side edge broom assembly and the at least one second side curb broom assembly are selectively deployable in a folded, storage or transport configuration and an extended, functional configuration.

16. The pavement sweeping apparatus of claim 15 wherein each of the first side edge broom mount member, the first side curb broom mount member, the second side edge broom mount member and the second side curb broom mount member is telescopically adjustable.

17. The pavement sweeping apparatus of claim 15 further comprising a gimbal joint assembly connecting each of the first side edge broom to the first side edge broom mount member, the first side curb broom to the first side curb broom mount member, the second side edge broom to the second side edge broom mount member and the second side curb broom to the second side curb broom mount member.

18. The pavement sweeping apparatus of claim 15 further comprising a pair of curb shoe broom assemblies carried by the sweeper frame on respective sides of the actuatable pickup broom.

19. The pavement sweeping apparatus of claim 15 further comprising at least one sweeper conveyor assembly including a sweeper conveyor assembly conveyor belt having a sweeper conveyor assembly conveyor belt loading end disposed beneath the at least one discharge opening and a sweeper conveyor assembly conveyor belt discharge end opposite the sweeper conveyor assembly conveyor belt loading end.

20. The pavement sweeping apparatus of claim 19 wherein the directionally mobile apparatus frame is configured for coupling to a pavement milling machine having at least one milling drum, and further comprising at least one primary conveyor configured for mounting on the pavement milling machine, the at least one primary conveyor having a primary conveyor belt with a primary conveyor belt loading end disposed beneath the sweeper conveyor assembly conveyor belt discharge end of the sweeper conveyor assembly conveyor belt and a primary conveyor belt discharge end disposed above and in front of the at least one milling drum.

21. The pavement sweeping apparatus of claim 15 further comprising at least one directing broom actuator carried by the directing broom assembly frame and engaging the broom mount frame for vertical positional adjustment of the at least one actuatable directing broom.

22. The pavement sweeping apparatus of claim 15 further comprising at least one pickup broom actuator carried by the sweeper assembly frame and engaging the at least one actuatable pickup broom for vertical positional adjustment of the at least one actuatable pickup broom.

23. A pavement sweeping apparatus, comprising:

a directionally mobile apparatus frame configured for coupling to a pavement milling machine having at least one milling drum;

at least one pickup unit carried by the apparatus frame, the at least one pickup unit having a first side and a second side and at least one discharge opening;

at least one sweeper conveyor assembly including a sweeper conveyor assembly conveyor belt having a sweeper conveyor assembly conveyor belt loading end disposed beneath the at least one discharge opening and a sweeper conveyor assembly conveyor belt discharge end opposite the sweeper conveyor assembly conveyor belt loading end disposed above and in front of the at least one milling drum;

at least one primary conveyor configured for mounting on the pavement milling machine, the at least one primary conveyor having a primary conveyor belt with a primary conveyor belt loading end disposed beneath the sweeper conveyor assembly conveyor belt discharge end of the sweeper conveyor assembly conveyor belt and aprimary conveyor belt discharge end disposed above and in front of the at least one milling drum;

at least one actuatable first side edge broom carried by the apparatus frame on the first side and forward of the at least one pickup unit;

at least one actuatable first side curb broom carried by the apparatus frame on the first side and forward of the at least one pickup unit;

at least one actuatable second side edge broom carried by the apparatus frame on the second side and forward of the at least one pickup unit; and at least one actuatable second side curb broom carried by the apparatus frame on the second side and forward of the at least one pickup unit.

24. The pavement sweeping apparatus of claim 23 further comprising at least one actuatable directing broom carried by the apparatus frame generally on the first side and forward of the at least one pickup unit, and wherein the at least one actuatable first side edge broom and the at least one actuatable first side curb broom are disposed generally on the first side and forward of the at least one actuatable directing broom.

25. The pavement sweeping apparatus of claim 23 wherein the at least one pickup unit comprises at least one pickup broom.

* * * * *